US009150037B2

(12) United States Patent
Anzai

(10) Patent No.: US 9,150,037 B2
(45) Date of Patent: Oct. 6, 2015

(54) INDIVIDUAL SHEET OVERLAPPING MECHANISM, FOLDING DEVICE, AND PRINTING APPARATUS, AND INDIVIDUAL SHEET OVERLAPPING METHOD

(71) Applicant: Kabushiki Kaisha Tokyo Kikai Seisakusho, Tokyo (JP)

(72) Inventor: Takanori Anzai, Kisarazu (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 14/601,796

(22) Filed: Jan. 21, 2015

(65) Prior Publication Data

US 2015/0210095 A1 Jul. 30, 2015

(30) Foreign Application Priority Data

Jan. 24, 2014 (JP) ..... 2014-011727

(51) Int. Cl.

| | |
|---|---|
| ***B41J 2/01*** | (2006.01) |
| ***B41J 11/70*** | (2006.01) |
| ***B65H 37/06*** | (2006.01) |
| ***B65H 35/00*** | (2006.01) |

(52) U.S. Cl.

CPC ..... *B41J 11/70* (2013.01); *B65H 35/0073* (2013.01); *B65H 37/06* (2013.01)

(58) Field of Classification Search

CPC .. B41J 11/0095; B41J 13/0009; B41J 13/009; B65H 2220/01; B65H 2220/02; B65H 2220/03; B65H 2701/1313

USPC ..... 347/16, 101, 104; 271/3.14, 4.1, 122, 271/125, 231, 237, 270

See application file for complete search history.

(56) References Cited

U.S. PATENT DOCUMENTS

| | | | | |
|---|---|---|---|---|
| 8,152,168 | B2 * | 4/2012 | Rossfeldt | 271/270 |
| 8,277,016 | B2 * | 10/2012 | Moriyama et al. | 347/16 |
| 8,430,393 | B2 * | 4/2013 | Matsushima et al. | 271/10.13 |
| 2012/0242027 | A1 | 9/2012 | Egli et al. | |

FOREIGN PATENT DOCUMENTS

| | | |
|---|---|---|
| JP | 2011157168 A | 8/2001 |

* cited by examiner

*Primary Examiner* — An Do

(74) *Attorney, Agent, or Firm* — The Webb Law Firm

(57) ABSTRACT

An individual sheet overlapping mechanism includes holding cylinders having paper edge holding mechanisms capable of holding a front edge portion in a conveying direction of a first individual sheet and that are provided rotatably along the conveying direction of the first individual sheet. The holding cylinders are configured to wrap the first individual sheet that has reached the holding cylinders around the holding cylinders by the paper edge holding mechanisms, release the first individual sheet at a timing when a second individual sheet has reached the holding cylinders, and stack the first individual sheet on the second individual sheet.

5 Claims, 13 Drawing Sheets

INDIVIDUAL SHEET OVERLAPPING MECHANISM, FOLDING DEVICE, AND PRINTING APPARATUS, AND INDIVIDUAL SHEET OVERLAPPING METHOD

CROSS REFERENCE TO RELATED APPLICATIONS

This application is based upon and claims the benefit of priority from prior Japanese Patent Application No. 2014-11727, filed on Jan. 24, 2014, the entire contents of which are incorporated herein by reference.

BACKGROUND OF THE INVENTION

1. Field of the Invention

The present invention relates to an individual sheet overlapping mechanism for overlapping two or more individual sheets having different cutoffs (cutting lengths), a folding device, and a printing apparatus, and to an individual sheet overlapping method.

2. Description of the Related Art

Conventionally, an ink jet printing type newspaper production device has been proposed as a device for producing a newspaper form signature (see JP 2011-157168A). The newspaper production device disclosed in Patent Document 1 includes a paper feed unit that supplies a continuous paper, an ink jet printing unit capable of printing on both sides of the continuous paper, and a folding unit that cuts and folds the post-printing continuous paper. This folding unit is a rotary folding unit comprising a folding cylinder that includes a holding mechanism that holds paper on an outer peripheral surface of the folding cylinder and a folding blade mechanism that thrusts the held paper in an outwardly radial direction. Moreover, this folding unit is configured capable of executing a so-called collect run in which paper held by the holding mechanism is folded every plurality of rotations of the folding cylinder to produce the signature.

In an ink jet printing type newspaper production device as in the newspaper production device of Patent Document 1, contrary to in a conventional offset press, there is no need for a plate, hence there is no limit to the number of pages of different contents capable of being printed in a direction of continuity of one continuous paper. Therefore, due to the ink jet printing type newspaper production device, it is possible to print pages of required content in a predetermined order on the continuous paper, cut the printed continuous paper to form individual sheets, and overlap and fold these individual sheets, thereby producing a signature configured from a plurality of individual sheets having pages of different content printed thereon. In this way, the ink jet printing type newspaper production device can produce a signature of any number of pages provided there is one printing unit capable of printing on both sides of the continuous paper. Hence, the ink jet printing type newspaper production device has the advantage of being able to produce a newspaper at low cost and in a space-saving manner, without the need to increase the number of printing units corresponding to the number of pages as in a conventional offset press.

SUMMARY OF THE INVENTION

However, when producing a newspaper form signature of blanket (broadsheet) size (length 545 mm by width 406.5 mm) in a conventional ink jet printing type newspaper production device, it is required to set a width direction of the continuous paper as a length direction of the newspaper, cut the printed continuous paper to a length of two page widths of the newspaper (813 mm) in the direction of continuity of the continuous paper to form individual sheets of four pages including both sides (length 545 mm by width 813 mm), and after overlapping those individual sheets sequentially on a folding cylinder, fold those individual sheets at their center in the direction of continuity, thereby producing the signature. Therefore, there is a problem that the conventional ink jet printing type newspaper production device can only produce a signature having a number of pages which is a multiple of four. That is, in the conventional ink jet printing type newspaper production device, there is a problem that it is not possible to insert a half-size paper of two pages including both sides cut in a length of one page width of the newspaper (406.5 mm) between pages of the newspaper form signature, hence it becomes impossible to freely choose the number of pages (for example, a number of pages that cannot be divided by four, such as 34 pages or 38 pages) according to the amount of articles or advertisements to be printed in the newspaper, thereby causing inconvenience in newspaper editing.

The present invention was made in view of the above problems of the conventional technology, and an object of the present invention is to provide an individual sheet overlapping mechanism capable of inserting a half-size paper of two pages in a signature having a number of pages which is a multiple of four, a folding device, and a printing apparatus, and to provide an individual sheet overlapping method.

An individual sheet overlapping mechanism according to the present invention is an individual sheet overlapping mechanism for overlapping a first individual sheet on a second individual sheet, the first individual sheet being conveyed from an upstream side and the second individual sheet being conveyed thereafter and having a length in a conveying direction which is longer than a length in the conveying direction of the first individual sheet, the individual sheet overlapping mechanism comprising: a holding cylinder that includes a paper edge holding mechanism capable of holding a front edge portion in the conveying direction of the first individual sheet and that is provided rotatably along the conveying direction of the first individual sheet, the holding cylinder being configured to wrap the first individual sheet that has reached said holding cylinder around said holding cylinder by the paper edge holding mechanism, release said first individual sheet at a timing when the second individual sheet has reached said holding cylinder, and stack said first individual sheet on said second individual sheet.

The individual sheet overlapping mechanism may be an individual sheet overlapping mechanism for overlapping each first individual sheet of a plurality of the first individual sheets conveyed continuously from the upstream side on each second individual sheet of a plurality of the second individual sheets conveyed continuously thereafter, in which case it is preferable that the same number of the holding cylinders as the number of continuously conveyed first individual sheets are provided along a conveying path of the first individual sheet and each of the holding cylinders holds one each of the first individual sheets and stacks the first individual sheet on each of the second individual sheets, thereby configuring the holding cylinder to produce the same number of stacked bodies as the number of continuously conveyed first individual sheets.

A folding device according to the present invention is a folding device comprising the above-described individual sheet overlapping mechanism, the folding device further comprising: a cutting mechanism configured to be capable of switching between a first cutting mode and a second cutting mode at any timing, the first cutting mode cutting a continuous paper to the length in the conveying direction of the first individual sheet and the second cutting mode cutting the continuous paper to the length in the conveying direction of the second individual sheet; a conveyor mechanism that is provided on a downstream side of the cutting mechanism and conveys the first individual sheet and the second individual sheet; and a folding mechanism that is provided on a downstream side of the conveyor mechanism and folds an individual sheet group including at least a stacked body of the first individual sheet stacked on the second individual sheet, and the individual sheet overlapping mechanism being provided on a conveying path of the conveyor mechanism.

A printing apparatus according to the present invention is a printing apparatus comprising the above-described folding device, the printing apparatus further comprising: an ink jet printing unit provided on an upstream side of the cutting mechanism.

An individual sheet overlapping method according to the present invention is an individual sheet overlapping method for overlapping a first individual sheet on a second individual sheet, the first individual sheet being conveyed from an upstream side and the second individual sheet being conveyed thereafter and having a length in a conveying direction which is longer than a length in the conveying direction of the first individual sheet, the individual sheet overlapping method comprising: employing an individual sheet overlapping mechanism comprising a holding cylinder that includes a paper edge holding mechanism capable of holding a front edge portion in the conveying direction of the first individual sheet and that is provided rotatably along the conveying direction of the first individual sheet to wrap the first individual sheet that has reached the holding cylinder around said holding cylinder by the paper edge holding mechanism, and then release said first individual sheet at a timing when the second individual sheet has reached said holding cylinder, thereby stacking said first individual sheet on said second individual sheet.

The present invention makes it possible to provide an individual sheet overlapping mechanism capable of inserting a half-size paper of two pages in a signature having a number of pages which is a multiple of four, a folding device, and a printing apparatus, and to provide an individual sheet overlapping method.

BRIEF DESCRIPTION OF THE DRAWINGS

FIG. 5(*a*) is a process drawing showing schematically a state where a paper holding pin of the first holding cylinder is stabbed into a leading first individual sheet. FIGS. 5(*b*) to 5(*d*) are process drawings showing how the situation develops over time from the state of FIG. 5(*a*) every time the first holding cylinder makes a half rotation.

FIGS. 6(*a*) to 6(*d*) are process drawings showing how the situation develops over time from the state of FIG. 5(*d*) every time the first holding cylinder makes a half rotation.

DETAILED DESCRIPTION OF THE EMBODIMENTS

Preferred embodiments for carrying out the present invention are described below with reference to the drawings. Note that the following embodiments are not intended to limit the inventions set forth in the claims, and the combinations of features described in the embodiments are not all necessarily indispensable for the means for solving the problem provided by the invention.

Figure 1:
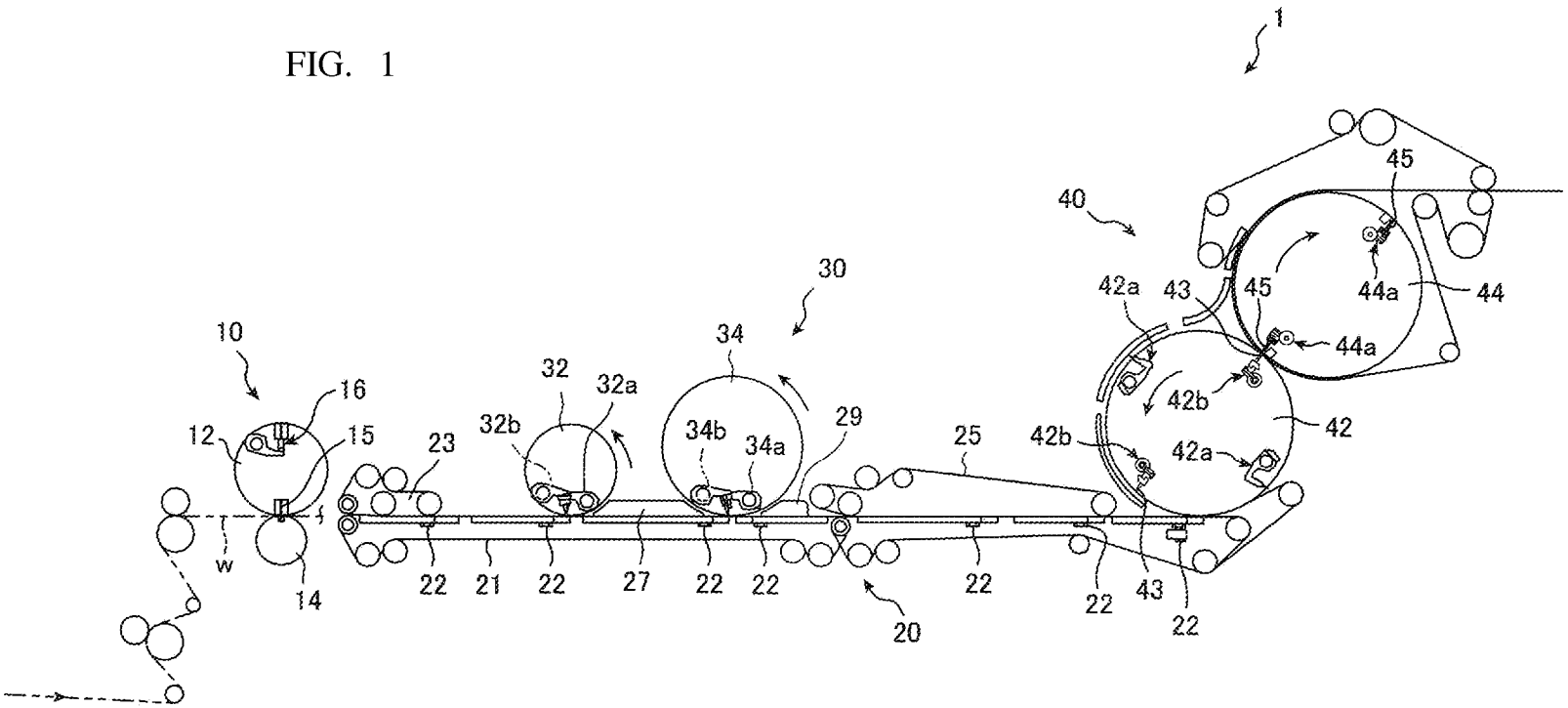
FIG. 1 is a schematic elevation view showing an overall configuration of a printing apparatus including an individual sheet overlapping mechanism and a folding device according to a present embodiment. Part of the configuration is omitted.

As shown in FIG. 1, a printing apparatus according to a present embodiment comprises: a continuous paper supply unit (not illustrated) having roll paper set therein, the roll paper being a continuous paper W wound in a roll shape; an ink jet printing unit (not illustrated) that performs ink jet printing (digital printing) on both sides of the continuous paper W supplied from the continuous paper supply unit; a folding device 1 that cuts the post-ink jet printing continuous paper W to form various individual sheets (flat papers) and folds an individual sheet group configured from two or more individual sheets to form a signature; a post-processing mechanism (not illustrated) that collects by performing certain processings such as further folding in two the signature formed by the folding device 1; and one or a plurality of control units (not illustrated) that execute various kinds of control of each configuration. Note that in the printing apparatus according to the present embodiment, a variety of publicly known continuous paper supply units and post-processing mechanisms may be employed, hence descriptions of the continuous paper supply unit and the post-processing mechanism will be omitted.

The ink jet printing unit is configured to be capable of continuously printing any number at a time of pages of identical or different content in any order on the continuous paper W, based on a preset composition of the signature. A variety of publicly known ink jet printing units may be employed as such an ink jet printing unit.

The folding device 1 according to the present embodiment is a folding device for producing two copies at a time of a signature configured from a number of pages that is an integer multiple of 4 with 2 added thereto (for example, 6, 10, 14, 18, 22, 26, 30, 34 pages, and so on). Specifically, as shown in FIG. 1, the folding device 1 according to the present embodiment comprises: a cutting mechanism 10 that cuts the post-ink jet printing continuous paper W to form a first individual sheet FP1 (first individual sheet) and a second individual sheet FP2 (second individual sheet); a conveyor mechanism 20 that conveys the post-cutting first individual sheet FP1 and second individual sheet FP2 to a downstream side; an individual sheet overlapping mechanism 30 that is provided on a conveying path (at an intermediate portion thereof) of the conveyor mechanism 20 and that overlaps the first individual sheet FP1 conveyed from an upstream side on the second individual sheet FP2 conveyed thereafter; and a folding mechanism 40 that folds an individual sheet group including at least a stacked body L configured from the first individual sheet FP1 and the second individual sheet FP2 conveyed from the conveyor mechanism 20 (that is, an upstream side).

Now, the first individual sheet FP1 refers to an individual sheet that has a length in a conveying direction which is shorter than a length in the conveying direction of the second individual sheet FP2 and has printing of different content performed on its front side and its reverse side. In the description of the present embodiment, the first individual sheet FP1 is assumed to be configured from a size which is half that of a broadsheet (length 545 mm by width 813 mm) and to refer to a half-size paper (length 545 mm by width 406.5 mm) on which a total of a two page portion of printing has been performed on its front side and its reverse side. Moreover, the second individual sheet FP2 refers to an individual sheet that has a length in the conveying direction which is longer than the length in the conveying direction of the first individual sheet FP1 and has printing of different content performed on each of right and left of its front side and right and left of its reverse side. In the description of the present embodiment, the second individual sheet FP2 is assumed to refer to a broadsheet (length 545 mm by width 813 mm) on which a total of a four page portion of printing has been performed on its front side and its reverse side. Note that in the description of the present embodiment, length of paper size refers to a width direction of the continuous paper W, and width of paper size refers to the conveying direction (direction of continuity). In addition, the stacked body L refers to a stacked body formed by stacking one first individual sheet FP1 on one second individual sheet FP2 such that their front edge portions in the conveying direction are aligned. Furthermore, the individual sheet group is assumed to refer to the stacked body L or a stacked body formed by having one or more second individual sheets FP2 further stacked on a second individual sheet FP2 side of the stacked body L.

Figure 2:
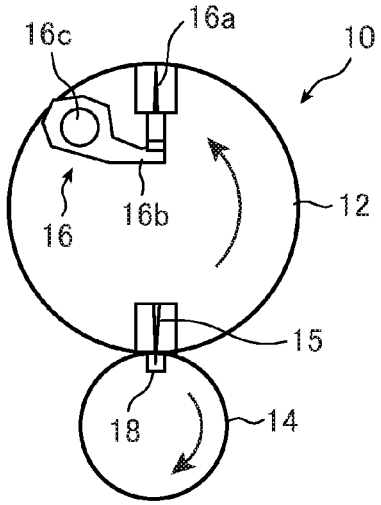
FIG. 2 is an enlarged elevation view showing a schematic configuration of a cutting mechanism.

As shown in FIGS. 1 and 2, the cutting mechanism 10 is a rotary cutting mechanism comprising a cutter cylinder 12 and a cutter-receiving cylinder 14 disposed facing each other bounded by the continuous paper W.

The cutter cylinder 12 is a cylinder formed in a columnar shape having a circumferential length substantially equal to the length in the conveying direction of the second individual sheet FP2 and is provided rotatably along the conveying direction of the continuous paper W around a rotating shaft (not illustrated) extending in a direction orthogonal to the conveying direction of the continuous paper W and parallel to a planar surface of the continuous paper W. As shown in FIG. 2, the cutter cylinder 12 has provided thereto, with a spacing of 180° in a circumferential direction, a fixed cutter blade 15 whose blade edge is always projected outwardly in a radial direction from a circumferential surface of the cutter cylinder 12 and a movable cutter blade mechanism 16 whose blade edge can be projected (advanced) or retracted (withdrawn) at any timing from the circumferential surface of the cutter cylinder 12.

The movable cutter blade mechanism 16 comprises: a movable cutter blade 16*a* having a blade edge capable of cutting in the width direction of the continuous paper W; a holder 16*b* that holds the movable cutter blade 16*a*; and a support shaft 16*c* to which the holder 16*b* is attached. In addition, the movable cutter blade mechanism 16 comprises an angular displacement means (not illustrated) capable of causing back-and-forth angular displacement (that is, axial rotation in a positive direction and then axial rotation in a reverse direction) of the support shaft 16*c* at any timing. The support shaft 16*c* is connected to the angular displacement means and is configured to undergo back-and-forth angular displacement at any timing, by said angular displacement means. The holder 16*b* is configured to oscillate around the support shaft 16*c* in a direction substantially orthogonal to the circumferential surface of the cutter cylinder 12 and project (advance) or retract (withdraw) the blade edge of the movable cutter blade 16*a* from the circumferential surface of the cutter cylinder 12, based on angular displacement of the support shaft 16*c*.

Employable as the angular displacement means is, for example, a cam mechanism comprising: a drive cam having on its circumferential surface a retraction region enabling the blade edge of the movable cutter blade 16*a* to be retracted from the circumferential surface of the cutter cylinder 12; a masking cam having on its circumferential surface a mask portion enabling the blade edge of the movable cutter blade 16*a* to be projected from the circumferential surface of the cutter cylinder 12 by disabling the retraction region of the drive cam; a masking cam drive means that causes angular displacement of the masking cam around a shaft center between a masking position and a non-masking position at any timing; a drive cam-dedicated cam follower that is connected to the support shaft 16*c* and moves along a circumferential surface of the drive cam; and a masking cam-dedicated cam follower that is connected to the support shaft 16*c* and moves along a circumferential surface of the masking cam. This cam mechanism is configured to retract the blade edge of the movable cutter blade 16*a* from the circumferential surface of the cutter cylinder 12 in a state where the masking cam is positioned in the non-masking position and project the blade edge of the movable cutter blade 16*a* from the circumferential surface of the cutter cylinder 12 to cut the continuous paper W in a state where the masking cam is positioned in the masking position. Note that the angular displacement means is not limited to said cam mechanism, and a variety of publicly known angular displacement means may be employed.

As shown in FIGS. 1 and 2, the cutter-receiving cylinder is a cylinder formed in a columnar shape having a circumferential length substantially equal to half of the length in the conveying direction of the second individual sheet FP2 (that is, the length in the conveying direction of the first individual sheet FP1) and is provided rotatably along the conveying direction of the continuous paper W around a rotating shaft (not illustrated) parallel to the rotating shaft of the cutter cylinder 12. As shown in FIG. 2, a recess 18 into which the fixed cutter blade 15 and the movable cutter blade 16*a* of the cutter cylinder 12 can be advanced, is formed along an axial direction in the circumferential surface of the cutter-receiving cylinder 14. This recess 18 has provided thereto a cutter receiver (not illustrated) configured from an elastic body such as rubber, and is configured to receive the fixed cutter blade 15 and the movable cutter blade 16*a* of the cutter cylinder 12 by said cutter receiver.

These cutter cylinder 12 and cutter-receiving cylinder 14 are synchronously controlled to rotate with circumferential speeds that are equal to each other in a phase relationship where the blade edge of the fixed cutter blade 15 and the blade edge of the movable cutter blade 16*a* of the cutter cylinder 12 advance into the recess 18 of the cutter-receiving cylinder 14. That is, the cutter cylinder 12 and the cutter-receiving cylinder are rotationally controlled by a control unit (not illustrated) to have phases and circumferential speeds such that the cutter-receiving cylinder 14 makes one rotation every time the cutter cylinder 12 makes a half rotation and such that the fixed cutter blade 15 and the movable cutter blade 16*a* of the cutter cylinder 12 alternately face the recess 18 of the cutter-receiving cylinder 14.

In the present embodiment, the circumferential length of the cutter cylinder 12 is substantially equal to the length in the conveying direction of the second individual sheet FP2, hence the circumferential speeds of the cutter cylinder 12 and the cutter-receiving cylinder 14 are the same speed as a conveying speed of the continuous paper W. However, the circumferential lengths or circumferential speeds of the cutter cylinder 12 and the cutter-receiving cylinder 14 are appropriately changeable according to the length in the conveying direction of the second individual sheet FP2. That is, when the desired length in the conveying direction of the second individual sheet FP2 is longer than the circumferential length of the cutter cylinder 12, this may be handled by slowing the circumferential speed of the cutter cylinder 12 or changing to a cutter cylinder 12 of long circumferential length according to the length in the conveying direction of the second individual sheet FP2, and when the desired length in the conveying direction of the second individual sheet FP2 is shorter than the circumferential length of the cutter cylinder 12, this may be handled by quickening the circumferential speed of the cutter cylinder 12 or changing to a cutter cylinder 12 of short circumferential length according to the length in the conveying direction of the second individual sheet FP2. Note that the configuration of the cutter-receiving cylinder 14 is changed along with the change of the cutter cylinder 12. In this way, the cutting mechanism 10 according to the present embodiment is configured to be capable of handling also so-called variable cutoff where the lengths in the conveying direction of the first individual sheet FP1 and the second individual sheet FP2 are changed to any lengths.

In addition, the movable cutter blade mechanism 16 of the cutter cylinder 12 is configured to be capable of changing the timing at which the blade edge of the movable cutter blade 16*a* projects from the circumferential surface of the cutter cylinder 12 according to the number of pages of the signature being produced. For example, when producing two copies at a time of a signature of six pages, the movable cutter blade mechanism 16 is adjusted such that the blade edge of the movable cutter blade 16*a* projects one time every three times that the movable cutter blade 16*a* faces (makes closest approach to) the recess 18 of the cutter-receiving cylinder 14. Moreover, when producing two copies at a time of a signature of 10 pages, the movable cutter blade mechanism 16 is adjusted such that the blade edge of the movable cutter blade 16*a* projects one time every five times that the movable cutter blade 16*a* faces (makes closest approach to) the recess 18 of the cutter-receiving cylinder 14. That is, the movable cutter blade mechanism 16 is adjusted such that the blade edge of the movable cutter blade 16*a* projects one time every "2N+1" (where N is an integer of 1 or more) times that the movable cutter blade 16*a* faces (makes closest approach to) the recess 18 of the cutter-receiving cylinder 14, and is thereby configured to be capable of producing two copies at a time of a signature configured from "4N+2" pages. Note that adjustment of timing of projection of the movable cutter blade 16*a* may be performed by changing or adjusting the cam mechanism, and so on, manually, or may be automatically controlled by a control unit (not illustrated) based on information of signature composition inputted from an input means (not illustrated).

The cutting mechanism 10 configured as above makes it possible to cut the continuous paper W to the length in the conveying direction of the second individual sheet FP2 by employing only the fixed cutter blade 15, and to cut the continuous paper W to the length in the conveying direction of the first individual sheet FP1 by employing both the fixed cutter blade 15 and the movable cutter blade 16*a*. That is, the cutting mechanism 10 is configured to be switchable between a first cutting mode and a second cutting mode at any timing, the first cutting mode cutting the continuous paper W to the length in the conveying direction of the first individual sheet FP1 by projecting the blade edge of the movable cutter blade 16*a* from the circumferential surface of the cutter cylinder 12 to cut the continuous paper W using both the fixed cutter blade 15 and the movable cutter blade 16*a*, and the second cutting mode cutting the continuous paper W to the length in the conveying direction of the second individual sheet FP2 by retracting the blade edge of the movable cutter blade 16*a* from the circumferential surface of the cutter cylinder 12 to cut the continuous paper W using only the fixed cutter blade 15.

As shown in FIG. 1, the conveyor mechanism 20 comprises a lower conveyor belt 21, a lower suction device 22, a first upper conveyor belt 23, a second upper conveyor belt 25, a first guide member 27, and a second guide member 29, and is configured to convey the first individual sheet FP1 and the second individual sheet FP2 cut by the cutting mechanism 10 toward the folding mechanism 40.

Figure 3:
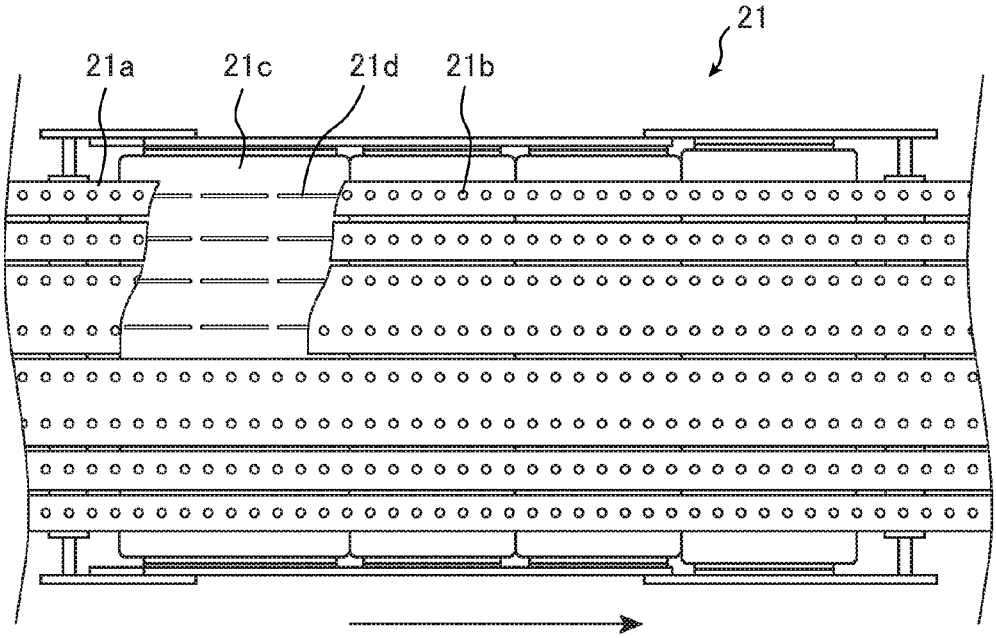
FIG. 3 is a partially cutout plan view showing a schematic configuration of a lower conveyor belt.

As shown in FIG. 1, the lower conveyor belt 21 is provided in a region from a close vicinity to a downstream side of the cutting mechanism 10 to a folding cylinder 42 of the folding mechanism 40. As shown in FIG. 3, this lower conveyor belt 21 includes a belt portion 21*a*, a belt portion suction hole 21*b*, a top plate 21*c*, and a top plate suction hole 21*d*. Moreover, the lower conveyor belt 21 is a conveyor mechanism installed in a lower portion of the conveying path of the first individual sheet FP1 and the second individual sheet FP2. The lower conveyor belt 21, along with the first upper conveyor belt 23, the second upper conveyor belt 25, the first guide member 27, and the second guide member 29, conveys the first individual sheet FP1 and the second individual sheet FP2 by sandwiching the first individual sheet FP1 and the second individual sheet FP2 from above and below.

As shown in FIG. 1, the belt portion 21*a* is a belt suspended by a plurality of rollers. The belt portion 21*a* forms a certain path by being suspended by the plurality of rollers and circuits using a rotational driving force of the rollers as a power source. This certain path includes the conveying path of the first individual sheet FP1 and the second individual sheet FP2. The conveying path of the first individual sheet FP1 and the second individual path FP2 in the lower conveyor belt 21 is from immediately after the cutting mechanism 10 to a position at which a later-described paper edge holding mechanism 42*a* installed in the folding cylinder 42 of the folding mechanism 40 operates.

As shown in FIG. 3, the belt portion suction hole 21*b* is a circular-shaped round hole formed in the belt portion 21*a*. Moreover, the belt portion suction holes 21*b* are formed in a plurality with a certain pitch along the conveying direction of the first individual sheet FP1 and the second individual sheet FP2, and are formed in a plurality of columns with a certain spacing in a direction orthogonal to the conveying direction and parallel to the planar surface of each of the individual sheets FP1 and FP2. In view of the length in the conveying direction of the first individual sheet FP1 and the second individual sheet FP2 conveyed, in order to convey the individual sheet FP1 and the individual sheet FP2 stably, the pitch in the longer direction of the belt portion suction holes 21*b* is preferably about 25 mm.

The top plate 21*c* is installed on an inner side of the lower conveyor belt 21 and is installed directly below the conveying path along which the individual sheet FP1 and the individual sheet FP2 pass in the lower conveyor belt 21. The top plate 21*c* is fixed to the likes of a frame of the entire printing apparatus, or a frame installed in the folding device 1. Moreover, the top plate 21*c* fixes the lower suction device 22.

The top plate suction hole 21*d* is a slit hole formed in the top plate 21*c*, and has a length along the conveying direction such as to straddle a plurality of the belt portion suction holes 21*b*. These top plate suction holes 21*d* are formed in a plurality with a certain pitch along the conveying direction of the first individual sheet FP1 and the second individual sheet FP2, and are formed in a plurality of columns with a spacing substantially the same as that between columns of the belt portion suctions holes 21*b* in a direction orthogonal to the conveying direction and parallel to the planar surface of each of the individual sheets FP1 and FP2.

Columns formed in parallel to the conveying direction of the belt portion suction hole 21*b* and columns formed in parallel to the conveying direction of the top plate suction hole 21*d* are formed such that respective columns overlap. Therefore, when the belt portion 21*a* is being driven, the belt portion suction hole 21*b* necessarily passes above the top plate suction hole 21*d*. As a result, the folding device 1 makes it possible for suction power from the lower suction device 22 to be transmitted to the first individual sheet FP1 and the second individual sheet FP2 via the belt portion suction hole 21*b*, thereby making it possible for the first individual sheet FP1 and the second individual sheet FP2 to be conveyed and passed to the folding cylinder 42 while being restrained.

A plurality of the lower suction devices 22 are installed below the conveying path of the first individual sheet FP1 and the second individual sheet FP2 in the lower conveyor belt 21. Since the lower suction device 22 is fixed to the top plate 21*c* forming the lower conveyor belt 21 and is not fixed directly to the belt portion 21*a*, the lower suction device 22 itself does not move. Moreover, suction power of the lower suction device 22 is transmitted to the first individual sheet FP1 and the second individual sheet FP2 via the belt portion suction hole 21*b*. Such a configuration enables the first individual sheet FP1 and the second individual sheet FP2 formed into sheets by cutting the continuous paper W to be conveyed reliably in a restrained state. Moreover, the lower suction device 22 is provided also in a lower portion of the folding cylinder 42 of the folding mechanism 40, whereby the first individual sheet FP1 and the second individual sheet FP2 can be conveyed in a restrained state without being set in a free state, hence stable conveying can be achieved and conveying defects can be prevented.

As shown in FIG. 1, the first upper conveyor belt 23 is a belt installed with a minute spacing in an upper portion of the conveying path of the first individual sheet FP1 and the second individual sheet FP2, and is provided in a region from a close vicinity of a downstream side of the cutting mechanism 10 to an upstream side of a first holding cylinder 32 of the individual sheet overlapping mechanism 30. This first upper conveyor belt 23 is configured to cooperate with the lower conveyor belt 21 to convey the first individual sheet FP1 and the second individual sheet FP2 immediately after cutting, toward the first holding cylinder 32.

The second upper conveyor belt 25 is a belt installed with a minute spacing in an upper portion of the conveying path of the first individual sheet FP1 and the second individual sheet FP2, and is provided in a region from a close vicinity of a downstream side of the second guide member 29 to a close vicinity of an upstream side of the folding cylinder 42 of the folding mechanism 40. This second upper conveyor belt 25 is configured to cooperate with the lower conveyor belt 21 to convey the stacked body L produced in the first holding cylinder 32 or a second holding cylinder 34, or the second individual sheet FP2 that has passed the first holding cylinder 32 and the second holding cylinder 34, toward the folding cylinder 42 of the folding mechanism 40.

The first guide member 27 is a plate-like member installed with a minute spacing in an upper portion of the conveying path of the first individual sheet FP1 and the second individual sheet FP2, and is provided between the first holding cylinder 32 and the second holding cylinder 34 of the individual sheet overlapping mechanism 30. This first guide member 27 is configured to prevent the stacked body L produced by the first holding cylinder 32, or the first individual sheet FP1 or second individual sheet FP2 that have passed the first holding cylinder 32 from rising up from the lower conveyor belt 21.

The second guide member 29 is a plate-like member installed with a minute spacing in an upper portion of the conveying path of the first individual sheet FP1 and the second individual sheet FP2, and is provided in a close vicinity of a downstream side of the second holding cylinder 34 of the individual sheet overlapping mechanism 30. This second guide member 29 is configured to prevent the stacked body L produced by the first holding cylinder 32 or second holding cylinder 34, or the second individual sheet FP2 that has passed the second holding cylinder 34 from rising up from the lower conveyor belt 21.

The lower conveyor belt 21, the first upper conveyor belt 23, and the second upper conveyor belt 25 are synchronously controlled to rotate with the same speed by a control unit (not illustrated). Specifically, the lower conveyor belt 21, the first upper conveyor belt 23, and the second upper conveyor belt 25 are controlled by a control unit (not illustrated) to convey the first individual sheet FP1 and the second individual sheet FP2 with any speed faster than the conveying speed of the continuous paper W supplied to the cutting mechanism 10, in the present embodiment with a speed about 5% faster than the conveying speed of the continuous paper W. In this way, by conveying the first individual sheet FP1 and the second individual sheet FP2 cut by the cutting mechanism 10 with a speed faster than the conveying speed of the continuous paper W, the conveyor mechanism 20 can form a certain gap between each of the individual sheets.

Note that the conveying speed of the first individual sheet FP1 and the second individual sheet FP2 by the conveyor mechanism 20, that is a drive speed of the lower conveyor belt 21, the first upper conveyor belt 23, and the second upper conveyor belt 25 is appropriately changeable according to the length in the conveying direction of the first individual sheet FP1 and the second individual sheet FP2. That is, the conveying speed of the conveyor mechanism 20 is changeably controlled by a control unit (not illustrated) to be a speed which is faster than the conveying speed of the continuous paper W supplied to the cutting mechanism 10 and such that the front edge portion of the conveyed stacked body L or second individual sheet FP2 is reliably held by the paper edge holding mechanism 42*a*. In this way, the conveyor mechanism 20 according to the present embodiment is configured to be capable of handling also so-called variable cutoff where the lengths in the conveying direction of the first individual sheet FP1 and the second individual sheet FP2 are changed to any lengths.

As shown in FIG. 1, the individual sheet overlapping mechanism 30 comprises: the first holding cylinder 32 and the second holding cylinder 34 provided along the conveying path in an upper portion of the lower conveyor belt 21 of the conveyor mechanism 20; and a control unit (not illustrated) that controls these first holding cylinder 32 and second holding cylinder 34. These first holding cylinder 32 and second holding cylinder 34 are disposed separated such that a distance along the conveying direction from a central shaft (rotating shaft) of the first holding cylinder 32 to a central shaft (rotating shaft) of the second holding cylinder 34 is substantially equal to the length in the conveying direction of the second individual sheet FP2.

Figure 4:
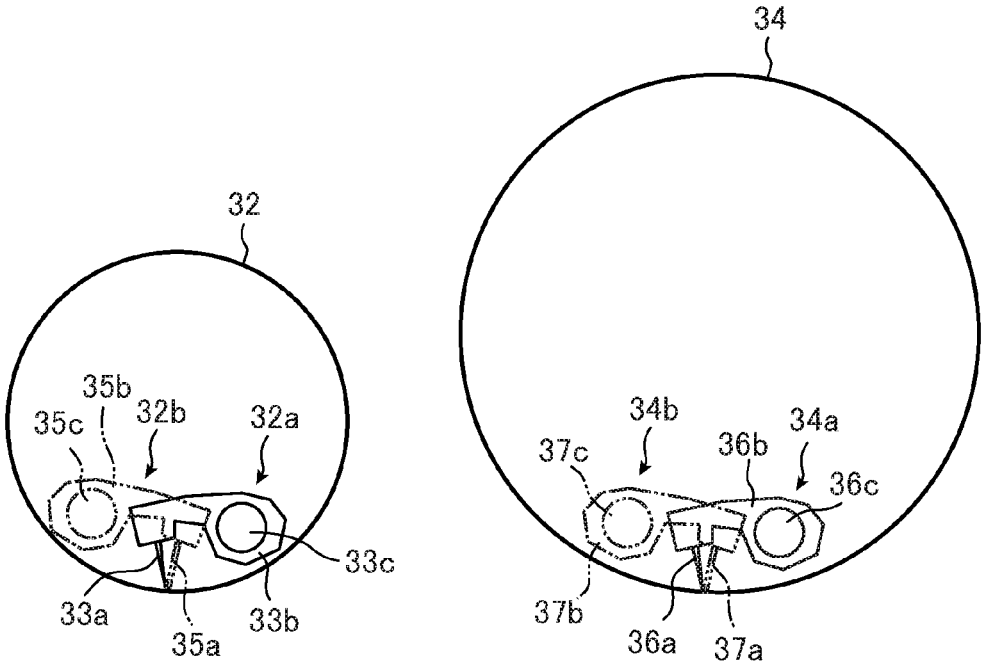
FIG. 4 is an enlarged elevation view showing schematic configurations of a first holding cylinder and a second holding cylinder.
Figure 5A:
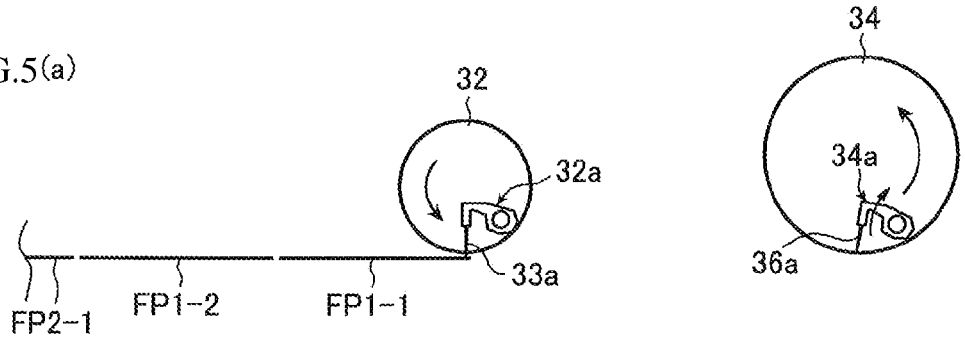
FIGS. 5(*a*) to 5(*d*) include views showing operation over time of the individual sheet overlapping mechanism according to the present embodiment.
Figure 5B:
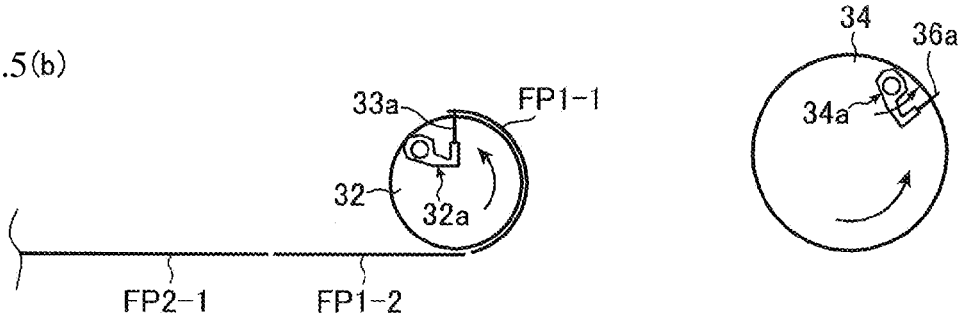
Figure 5C:
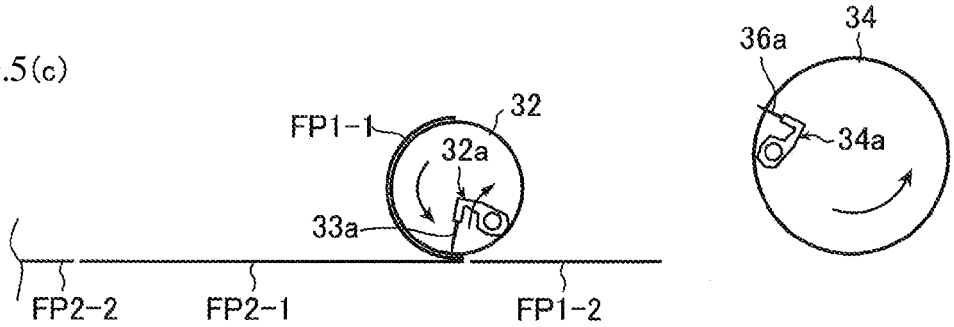
Figure 5D:
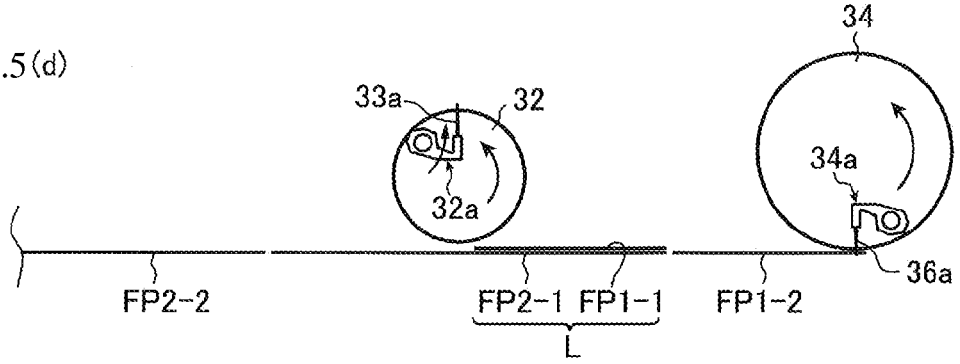

The first holding cylinder 32 is a cylinder (1 time cylinder) formed in a columnar shape having a circumferential length substantially equal to the length in the conveying direction of the second individual sheet FP2 and is provided rotatably along the conveying direction of each of the individual sheets FP1 and FP2 around a rotating shaft (not illustrated) extending in a direction orthogonal to the conveying direction of each of the individual sheets FP1 and FP2 and parallel to a planar surface of each of the individual sheets FP1 and FP2. As shown in FIG. 4, this first holding cylinder 32 includes: the paper edge holding mechanism 32*a* that can hold at any timing and release at any timing the front edge portion in the conveying direction of the first individual sheet FP1; and a detaching mechanism 32*b* that separates the first individual sheet FP1 from the circumferential surface of the first holding cylinder 32 when the paper edge holding mechanism 32*a* releases the first individual sheet FP1.

The paper edge holding mechanism 32*a* comprises: a plurality of paper holding pins 33*a* capable of being stabbed into the front edge portion in the conveying direction of the first individual sheet FP1; a holder 33*b* that holds the paper holding pin 33*a*; and a support shaft 33*c* to which the holder 33*b* is attached. In addition, the paper edge holding mechanism 32*a* comprises an angular displacement means (not illustrated) capable of causing back-and-forth angular displacement (that is, axial rotation in a positive direction and then axial rotation in a reverse direction) of the support shaft 33*c* at any timing. The support shaft 33*c* is connected to the angular displacement means and is configured to undergo back-and-forth angular displacement at any timing, by said angular displacement means. The holder 33*b* is configured to oscillate around the support shaft 33*c* in a direction substantially orthogonal to the circumferential surface of the first holding cylinder 32 and project (advance) or retract (withdraw) the paper holding pin 33*a* from the circumferential surface of the first holding cylinder 32, based on angular displacement of the support shaft 33*c*.

Employable as the angular displacement means is, for example, a cam mechanism comprising: a drive cam having on its circumferential surface a retraction region enabling the paper holding pin 33*a* to be retracted from the circumferential surface of the first holding cylinder 32; a masking cam having on its circumferential surface a mask portion enabling the paper holding pin 33*a* to be projected from the circumferential surface of the first holding cylinder 32 by disabling the retraction region of the drive cam; a masking cam drive means that causes angular displacement of the masking cam around a shaft center between a masking position and a non-masking position at any timing; a drive cam-dedicated cam follower that is connected to the support shaft 33*c* and moves along a circumferential surface of the drive cam; and a masking cam-dedicated cam follower that is connected to the support shaft 33*c* and moves along a circumferential surface of the masking cam. This cam mechanism is configured to retract the paper holding pin 33*a* from the circumferential surface of the first holding cylinder 32 in a state where the masking cam is positioned in the non-masking position and project the paper holding pin 33*a* from the circumferential surface of the first holding cylinder 32 to hold the first individual sheet FP1 in a state where the masking cam is positioned in the masking position. Note that the angular displacement means is not limited to said cam mechanism, and a variety of publicly known angular displacement means may be employed.

The detaching mechanism 32*b* comprises: a plurality of paper detaching portions 35*a* capable of separating the first individual sheet FP1 from the circumferential surface of the first holding cylinder 32; a holder 35*b* that holds the paper detaching portion 35*a*; and a support shaft 35*c* to which the holder 35*b* is attached. In addition, the detaching mechanism 32*b* comprises an angular displacement means (not illustrated) capable of causing back-and-forth angular displacement (that is, axial rotation in a positive direction and then axial rotation in a reverse direction) of the support shaft 35*c* at any timing. Note that, for example, a cam mechanism may be employed as such an angular displacement means similarly to in the paper edge holding mechanism 32*a*, but the angular displacement means is not limited to a cam mechanism, and a variety of publicly known angular displacement means may be employed. The support shaft 35*c* is connected to the angular displacement means and is configured to undergo back-and-forth angular displacement at any timing, by said angular displacement means. The holder 35*b* is configured to oscillate around the support shaft 35*c* in a direction substantially orthogonal to the circumferential surface of the first holding cylinder 32 and project (advance) or retract (withdraw) the paper detaching portion 35*a* from the circumferential surface of the first holding cylinder 32, based on angular displacement of the support shaft 35*c*.

As shown in FIG. 1, the second holding cylinder 34 is a cylinder (1.5 times cylinder) formed in a columnar shape having a circumferential length substantially equal to 1.5 times the length in the conveying direction of the second individual sheet FP2 and is provided rotatably along the conveying direction of each of the individual sheets FP1 and FP2 around a rotating shaft (not illustrated) extending in a direction orthogonal to the conveying direction of each of the individual sheets FP1 and FP2 and parallel to a planar surface of each of the individual sheets FP1 and FP2. As shown in FIG. 4, this second holding cylinder 34 includes: a paper edge holding mechanism 34*a* that can hold at any timing and release at any timing the front edge portion in the conveying direction of the first individual sheet FP1; and a detaching mechanism 34*b* that separates the first individual sheet FP1 from the circumferential surface of the second holding cylinder 34 when the paper edge holding mechanism 34*a* releases the first individual sheet FP1.

Similarly to the paper edge holding mechanism 32*a* of the first holding cylinder 32, the paper edge holding mechanism 34*a* comprises: a plurality of paper holding pins 36*a* capable of being stabbed into the front edge portion in the conveying direction of the first individual sheet FP1; a holder 36*b* that holds the paper holding pin 36*a*; and a support shaft 36*c* to which the holder 36*b* is attached. In addition, the paper edge holding mechanism 34*a* comprises an angular displacement means (not illustrated) capable of causing back-and-forth angular displacement (that is, axial rotation in a positive direction and then axial rotation in a reverse direction) of the support shaft 36*c* at any timing. Note that these paper holding pin 36*a*, holder 36*b*, support shaft 36*c*, and angular displacement means may employ a paper holding pin, holder, support shaft, and angular displacement means comprising similar configurations to those of the paper holding pin 33*a*, holder 33*b*, support shaft 33*c*, and angular displacement means of the paper edge holding mechanism 32*a* of the first holding cylinder 32, hence descriptions thereof will be omitted.

Similarly to the detaching mechanism 32*b* of the first holding cylinder 32, the detaching mechanism 34*b* comprises: a plurality of paper detaching portions 37*a* capable of separating the first individual sheet FP1 from the circumferential surface of the second holding cylinder 34; a holder 37*b* that holds the paper detaching portion 37*a*; and a support shaft 37*c* to which the holder 37*b* is attached. In addition, the detaching mechanism 34*b* comprises an angular displacement means (not illustrated) capable of causing back-and-forth angular displacement (that is, axial rotation in a positive direction and then axial rotation in a reverse direction) of the support shaft 37*c* at any timing. Note that these paper detaching portion 37*a*, holder 37*b*, support shaft 37*c*, and angular displacement means may employ a paper detaching portion, holder, support shaft, and angular displacement means comprising similar configurations to those of the paper detaching portion 35*a*, holder 35*b*, support shaft 35*c*, and angular displacement means of the detaching mechanism 32*b* of the first holding cylinder 32, hence descriptions thereof will be omitted.

The first holding cylinder 32 and the second holding cylinder 34 comprising the above kinds of configurations have their phases and circumferential speeds preset or are synchronously controlled by a control unit (not illustrated) such that there is a phase relationship where the paper holding pins 33*a* and 36*a* are each stabbed into the front edge portion in the conveying direction of the holding-target first individual sheet FP1 and such that the circumferential speeds of the first holding cylinder 32 and the second holding cylinder 34 are the same speed as the conveying speed in the conveyor mechanism 20. In addition, the first holding cylinder 32 and the second holding cylinder 34 are preset or controlled by a control unit (not illustrated) to continue holding of the holding-target first individual sheet FP1 until the front edge portion in the conveying direction of the stacking-target second individual sheet FP2 arrives, in the present embodiment while making one rotation in a state where the first individual sheet is held, and then release holding of the first individual sheet FP1 and operate the detaching mechanisms 32*b* and 34*b*.

Figure 7:
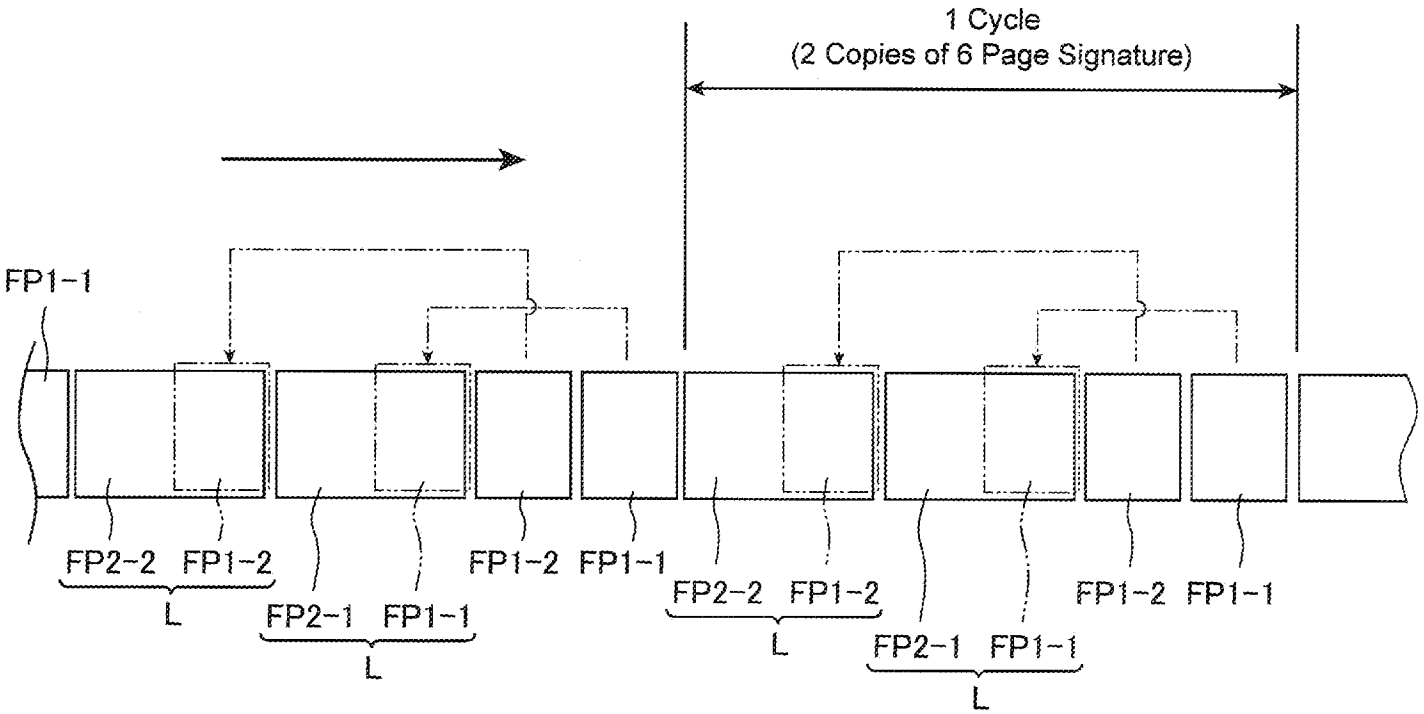
FIG. 7 is a schematic view showing a positional relationship of each of individual sheets when producing a signature configured from six pages using a 2 times cylinder (or an even number of 4 or more times cylinder) folding cylinder.

By being set or controlled in this way, the first holding cylinder 32 is configured to temporarily divert the holding-target first individual sheet FP1 (later-described leading first individual sheet FP1-1) from the conveying path of the conveyor mechanism 20 by wrapping the holding-target first individual sheet FP1 around the first holding cylinder 32, and return the holding-target first individual sheet FP1 to the conveying path of the conveyor mechanism 20 delayed by a portion of the circumferential length of the first holding cylinder 32, in the present embodiment by a portion of the length in the conveying direction of the second individual sheet FP2 (the length in the conveying direction of two portions of the first individual sheet FP1) (refer to FIG. 7). Moreover, by being set or controlled in this way, the second holding cylinder 34 is configured to temporarily divert the holding-target first individual sheet FP1 (later-described following first individual sheet FP1-2) from the conveying path of the conveyor mechanism 20 by wrapping the holding-target first individual sheet FP1 around the second holding cylinder 34, and return the holding-target first individual sheet FP1 to the conveying path of the conveyor mechanism 20 delayed by a portion of the circumferential length of the second holding cylinder 34, in the present embodiment by a portion of a length which is 1.5 times the length in the conveying direction of the second individual sheet FP2 (=the length in the conveying direction of one first individual sheet FP1+the length in the conveying direction of one second individual sheet FP2) (refer to FIG. 7). That is, the first holding cylinder 32 and the second holding cylinder 34 are configured to be capable of stacking the holding-target first individual sheet FP1 (later-described leading first individual sheet FP1-1 and following first individual sheet FP1-2) on the stacking-target second individual sheet FP2 (later-described leading second individual sheet FP2-1 and following second individual sheet FP2-2) conveyed thereafter delayed by a portion of the circumferential length of said cylinder (first holding cylinder 32 or second holding cylinder 34), in a state where respective front edge portions in the conveying direction are aligned.

As shown in FIG. 1, the folding mechanism 40 comprises: the folding cylinder 42 that sequentially wraps around itself the stacked body L or single second individual sheet FP2 conveyed from the conveyor mechanism 20 (that is, an upstream side); and a jaw cylinder 44 that receives the individual sheet group from the folding cylinder 42 to convey the individual sheet group to a downstream side.

The folding cylinder 42 is a cylinder (2 times cylinder) formed in a columnar shape having a circumferential length substantially equal to 2 times the length in the conveying direction of the second individual sheet FP2 and is provided rotatably along the conveying direction of each of the individual sheets FP1 and FP2 around a rotating shaft (not illustrated) extending in a direction orthogonal to the conveying direction of each of the individual sheets FP1 and FP2 and parallel to a planar surface of each of the individual sheets FP1 and FP2. In addition, the folding cylinder 42 comprises: two paper edge holding mechanisms 42*a* and 42*a* provided with a spacing of 180° in a circumferential direction; and two thrust blade mechanisms 42*b* and 42*b* similarly provided with a spacing of 180° in a circumferential direction.

The paper edge holding mechanism 42*a* is configured to be capable of holding at any timing and releasing at any timing the front edge portion in the conveying direction of the stacked body L or the single second individual sheet FP2 conveyed from the conveyor mechanism 20. Employable as such a paper edge holding mechanism 42*a* is a paper edge holding mechanism comprising a similar configuration to that of the paper edge holding mechanisms 32*a* and 34*a* of the first holding cylinder 32 and the second holding cylinder 34, hence a description thereof will be omitted.

The thrust blade mechanisms 42*b* are respectively provided at intermediate positions of the two paper edge holding mechanisms 42*a* and 42*a* and are configured to cause substantially the center in the conveying direction of the individual sheet group (the stacked body L or a stacked body having one or more second individual sheets FP2 stacked on this stacked body L) held by the paper edge holding mechanism 42*a* to be gripped by a jaw mechanism 44*a* of the jaw cylinder 44 by projecting a thrust blade 43 every time the thrust blade mechanism 42*b* reaches a position where a distance between the thrust blade mechanism 42*b* of the folding cylinder 42 and the jaw mechanism 44*a* of the jaw cylinder 44 is a minimum or every arbitrary number of times the thrust blade mechanism 42*b* reaches said position.

Specifically, the thrust blade mechanisms 42*b* each comprise: the thrust blade 43 attached to a support shaft provided parallel to a shaft center of the folding cylinder 42; and an angular displacement means (not illustrated) capable of causing back-and-forth angular displacement (that is, axial rotation in a positive direction and then axial rotation in a reverse direction) of this support shaft at any timing. The thrust blade 43 is formed in a blade shape capable of thrusting substantially the center in the conveying direction of the individual sheet group outwardly in a radial direction and is configured to oscillate around the support shaft in a direction substantially orthogonal to the circumferential surface of the folding cylinder 42 and project (advance) or retract (withdraw) a tip thereof from the circumferential surface of the folding cylinder 42, based on back-and-forth angular displacement of the support shaft. Note that, for example, a cam mechanism may be employed as the angular displacement means similarly to in the paper edge holding mechanism 32*a* of the first holding cylinder 32, but the angular displacement means is not limited to said cam mechanism, and a variety of publicly known angular displacement means may be employed.

The jaw cylinder 44 is a cylinder (2 times cylinder) formed in a columnar shape having a circumferential length equal to a circumferential length of the folding cylinder 42 and is configured to rotate around a rotating shaft (not illustrated) parallel to that of the folding cylinder 42 in a reverse direction to a rotating direction of the folding cylinder 42. Moreover, the jaw cylinder 44 comprises the two jaw mechanisms 44*a* and 44*a* provided with a spacing of 180° in a circumferential direction.

The jaw mechanisms 44*a* are respectively provided at positions corresponding to the thrust blade mechanisms 42*b* of the folding cylinder 42 and are configured to receive the thrust blade 43 when the distance between the thrust blade mechanism 42*b* of the folding cylinder 42 and the jaw mechanism 44*a* of the jaw cylinder 44 is a minimum and the thrust blade mechanism 42*b* is operated.

Specifically, the jaw mechanisms 44*a* each comprise: a jaw blade 45 attached to a support shaft provided parallel to a shaft center of the jaw cylinder 44; and an angular displacement means (not illustrated) capable of causing back-and-forth angular displacement (that is, axial rotation in a positive direction and then axial rotation in a reverse direction) of this support shaft at any timing. The jaw blade 45 is configured to move rotationally along the circumferential direction of the jaw cylinder 44 around the support shaft, grip substantially the center in the conveying direction of the individual sheet group thrust out by the thrust blade 43 of the thrust blade mechanism 42*b* of the folding cylinder 42 and fold in two said individual sheet group to form the signature, based on back-and-forth angular displacement of the support shaft. Note that, for example, a cam mechanism may be employed as the angular displacement means similarly to in the paper edge holding mechanism 32*a* of the first holding cylinder 32, but the angular displacement means is not limited to said cam mechanism, and a variety of publicly known angular displacement means may be employed.

Circumferential speeds of the folding cylinder 42 and the jaw cylinder 44 are preset or synchronously controlled by a control unit (not illustrated) to be the same speed as the conveying speed in the conveyor mechanism 20. When the circumferential speeds of the folding cylinder 42 and the jaw cylinder 44 and the conveying speed of the conveyor mechanism 20 are set to the same speed in this way, the stacked body L or single second individual sheet FP2 conveyed by the conveyor mechanism 20 can be smoothly wrapped onto the folding cylinder 42, hence it is possible to suppress occurrence of kinks or blockages, and the like.

The folding mechanism 40 comprising the above kind of configuration makes it possible to switch based on a preset composition of the signature to execute: a first signature producing mode (a so-called straight run) that passes the stacked body L wrapped around the folding cylinder 42 by the paper edge holding mechanism 42*a* of the folding cylinder 42 to the jaw mechanism 44*a* of the jaw cylinder 44 every half circumference of the folding cylinder 42; and a second signature producing mode (a so-called collect run) that, every time the folding cylinder 42 is rotated one circumference in a state where the stacked body L wrapped around the folding cylinder 42 by the paper edge holding mechanism 42*a* is held, stacks one following second individual sheet FP2 on the stacked body L, and that rotates the folding cylinder 42 N circumferences (where N is an integer of 1 or more) and after stacking N second individual sheets FP2, passes the N second individual sheets FP2 to the jaw mechanism 44*a* of the jaw cylinder 44. Note that in the second signature producing mode, by stacking the stacked body L at an arbitrary number of circumferences while the folding cylinder 42 is being rotated N circumferences and not holding the stacked body L initially, it is possible to change the order in which the stacked body L is stacked in the folding cylinder 42. Such a first signature producing mode makes it possible to produce two copies at a time of a six page signature. Moreover, the second signature producing mode makes it possible to produce two copies at a time of a "6+4N page" signature of, for example, 10, 14, 18, 22, 26, 30, 34, and so on, pages.

Note that the paper edge holding mechanism 42*a*, by for example further comprising the likes of a drive cam-dedicated drive means that causes angular displacement of a drive cam, may be configured to be capable of arbitrarily adjusting a release timing of the individual sheet group based on the length in the conveying direction of the second individual sheet FP2 (that is, the length in the conveying direction of the individual sheet group). Moreover, the thrust blade mechanism 42*b* may be configured to be capable of having its position in the circumferential direction in the folding cylinder 42 changed based on the length in the conveying direction of the second individual sheet FP2 (that is, the length in the conveying direction of the individual sheet group).

Furthermore, the jaw mechanism 44*a* may be configured to be capable of having its position in the circumferential direction in the jaw cylinder 44 changed based on a phase change of the thrust blade mechanism 42*b*. These paper edge holding mechanism 42*a*, thrust blade mechanism 42*b*, and jaw mechanism 44*a* make it possible to handle also so-called variable cutoff where the lengths in the conveying direction of the first individual sheet FP1 and the second individual sheet FP2 are changed to any lengths.

Next, operation of the individual sheet overlapping mechanism 30 according to the present embodiment will be described using FIGS. 5(*a*) to 5(*d*) and 6(*a*) to 6(*d*), taking as an example the case of producing two copies at a time of a six page signature. Note that FIGS. 5(*a*) to 5(*d*) and 6(*a*) to 6(*d*) are views showing in stages each of states where each of the individual sheets FP1 and FP2 is conveyed a portion of the length in the conveying direction of the first individual sheet FP1 at a time by the conveyor mechanism 20, and the first holding cylinder 32 rotates a half circumference at a time and second holding cylinder 34 rotates a third of a circumference at a time. Moreover, in FIGS. 5(*a*) to 5(*d*) and 6(*a*) to 6(*d*), illustration of each of the detaching mechanisms 32*b* and 34*b* of the first holding cylinder 32 and the second holding cylinder 34 is omitted.

Note that in the following description, a leading first individual sheet FP1-1 refers to a first individual sheet FP1 of two continuously conveyed first individual sheets FP1 that is positioned on a leading side in the conveying direction, and a following first individual sheet FP1-2 refers to a first individual sheet FP1 conveyed following the leading first individual sheet FP1-1 and positioned on a following side in the conveying direction. Moreover, a leading second individual sheet FP2-1 refers to a second individual sheet FP2 of two continuously conveyed second individual sheets FP2 that is positioned on a leading side in the conveying direction, and a following second individual sheet FP2-2 refers to a second individual sheet FP2 conveyed following the leading second individual sheet FP2-1 and positioned on a following side in the conveying direction.

First, as a pre-processing of an overlapping processing in the individual sheet overlapping mechanism 30, the ink jet printing unit prints a one page portion of content on each of the front side and the reverse side of the continuous paper W continuously two at a time, and then prints a two page portion of content on each of the front side and the reverse side of the continuous paper W continuously two at a time. Then, the cutting mechanism 10 cuts the printing-completed continuous paper W, using the fixed cutter blade 15 that is always projected and the movable cutter blade 16*a* that projects at a rate of one in three rotations, such that two first individual sheets FP1 having a one page portion length (cutoff) in the conveying direction are continuously formed and two second individual sheets FP2 having a two page portion length in the conveying direction are continuously formed. Then, the conveyor mechanism 20 continuously conveys the two first individual sheets FP1 and the two second individual sheets FP2 toward the folding cylinder 42. Note that printing by the ink jet printing unit, cutting by the cutting mechanism 10, and conveying by the conveyor mechanism 20 are executed continuously any number of cycles, assuming the above-described printing, cutting, and conveying to be one cycle.

Next, the individual sheet overlapping mechanism 30 executes processing that overlaps each of the first individual sheets FP1 of the two first individual sheets FP1 conveyed continuously from an upstream side on each of the second individual sheets FP2 of the two second individual sheets FP2 conveyed continuously thereafter to continuously produce the same number of stacked bodies L (that is, two stacked bodies L) as the number of continuously conveyed first individual sheets FP1.

Specifically, first, as shown in FIG. 5(*a*), when the leading first individual sheet FP1-1 conveyed from an upstream side of the holding cylinder 32 has reached the first holding cylinder 32, the first holding cylinder 32 operates to stab the paper holding pin 33*a* of the paper edge holding mechanism 32*a* into the front edge portion in the conveying direction of the leading first individual sheet FP1-1. Note that the first holding cylinder 32 has its phase and circumferential speed set or controlled such that the paper holding pin 33*a* of the paper edge holding mechanism 32*a* remains projected without being retracted at said timing to be stabbed into the front edge portion in the conveying direction of the leading first individual sheet FP1-1.

Then, as shown in FIG. 5(*b*), the first holding cylinder 32 operates to make a half rotation in a state where the leading first individual sheet FP1-1 is held by the paper holding pin 33*a* and wrap the leading first individual sheet FP1-1 around the first holding cylinder 32. As a result, the leading first individual sheet FP1-1 temporarily escapes from the conveying path of the conveyor mechanism 20. In addition, conveying by the conveyor mechanism 20 is continued along with rotation of the first holding cylinder 32, and the following first individual sheet FP1-2, the leading second individual sheet FP2-1, and the following second individual sheet FP2-2 positioned on the conveying path of the conveyor mechanism 20 are conveyed a portion of the length in the conveying direction of the first individual sheet FP1 toward a downstream side (the folding cylinder 42).

Then, as shown in FIG. 5(*c*), the first holding cylinder 32 in a state where the leading first individual sheet FP1-1 is held by the paper holding pin 33*a* makes a further half rotation, and the following first individual sheet FP1-2, the leading second individual sheet FP2-1, and the following second individual sheet FP2-2 positioned on the conveying path of the conveyor mechanism 20 are further conveyed a portion of the length in the conveying direction of the first individual sheet FP1 toward the downstream side (the folding cylinder 42). As a result, the leading second individual sheet FP2-1 reaches the first holding cylinder 32. At this time, the first holding cylinder 32 retracts the paper holding pin 33*a* to release holding of the leading first individual sheet FP1-1 and projects the paper detaching portion 35*a* of the detaching mechanism 32*b* to separate the leading first individual sheet FP1-1 from the first holding cylinder 32 and return the leading first individual sheet FP1-1 onto the conveying path of the conveyor mechanism 20. As a result, the leading first individual sheet FP1-1 is stacked on the leading second individual sheet FP2-1 in a state where their respective front edge portions in the conveying direction are aligned, and a stacked body L configured from the leading first individual sheet FP1-1 and the leading second individual sheet FP2-1 is formed. Note that the following first individual sheet FP1-2 passes the first holding cylinder 32 without being held in the first holding cylinder 32.

Then, as shown in FIG. 5(*d*), the following first individual sheet FP1-2, the stacked body L, and the following second individual sheet FP2-2 positioned on the conveying path of the conveyor mechanism 20 are further conveyed toward the downstream side (the folding cylinder 42), and when the following first individual sheet FP1-2 has reached the second holding cylinder 34, the second holding cylinder 34 operates to stab the paper holding pin 36*a* of the paper edge holding mechanism 34*a* into the front edge portion in the conveying direction of the following first individual sheet FP1-2. Note that the second holding cylinder 34 has its phase and circumferential speed set or controlled such that the paper holding pin 36*a* of the paper edge holding mechanism 34*a* remains projected without being retracted at said timing to be stabbed into the front edge portion in the conveying direction of the following first individual sheet FP1-2.

Figure 6:
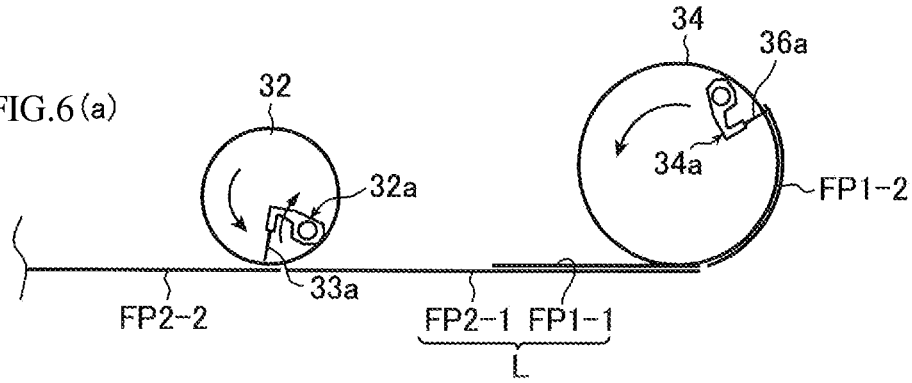
FIGS. 6(*a*) to 6(*d*) include views showing operation over time of the individual sheet overlapping mechanism according to the present embodiment.
Figure 6:
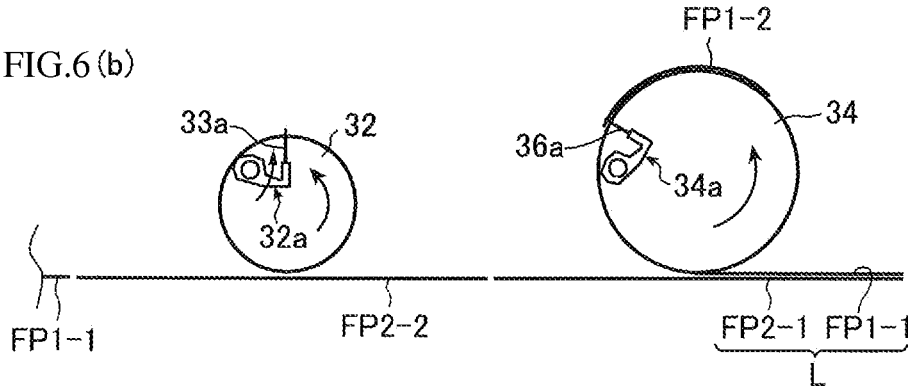
Figure 6:
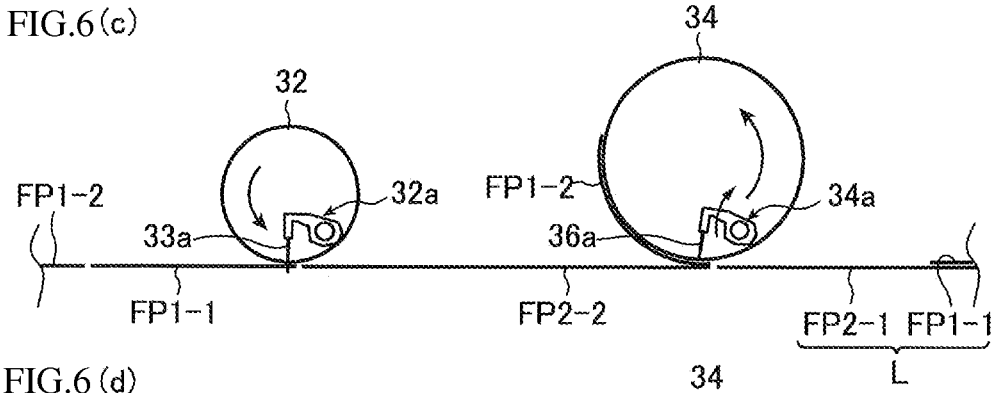
Figure 6:
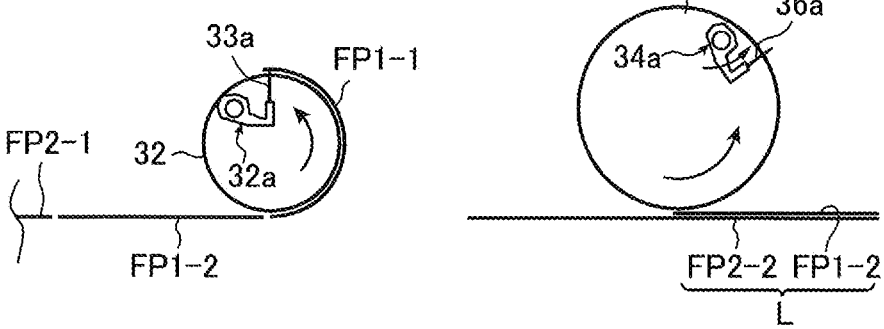

As shown in FIGS. 6(*a*) and 6(*b*), the second holding cylinder 34 in a state where the following first individual sheet FP1-2 is held by the paper holding pin 36*a* further rotates a third of a circumference at a time, and the stacked body L and the following second individual sheet FP2-2 positioned on the conveying path of the conveyor mechanism 20 are further conveyed a portion of the length in the conveying direction of the first individual sheet FP1 at a time toward the downstream side (the folding cylinder 42). Note that the following second individual sheet FP2-2 passes the first holding cylinder 32 without being held in the first holding cylinder 32.

Then, as shown in FIG. 6(*c*), the second holding cylinder 34 in a state where the following first individual sheet FP1-2 is held by the paper holding pin 36*a* rotates a further third of a circumference, and the stacked body L and the following second individual sheet FP2-2 positioned on the conveying path of the conveyor mechanism 20 are further conveyed a portion of the length in the conveying direction of the first individual sheet FP1 toward the downstream side (the folding cylinder 42). As a result, the following second individual sheet FP2-2 reaches the second holding cylinder 34, and the leading first individual sheet FP1-1 of the next cycle reaches the first holding cylinder 32. At this time, the second holding cylinder 34 retracts the paper holding pin 36*a* to release holding of the following first individual sheet FP1-2 and projects the paper detaching portion 37*a* of the detaching mechanism 34*b* to separate the following first individual sheet FP1-2 from the second holding cylinder 34 and return the following first individual sheet FP1-2 onto the conveying path of the conveyor mechanism 20. As a result, the following first individual sheet FP1-2 is stacked on the following second individual sheet FP2-2 in a state where their respective front edge portions in the conveying direction are aligned, and a stacked body L configured from the following first individual sheet FP1-2 and the following second individual sheet FP2-2 is formed. In addition, the first holding cylinder 32 operates to stab the paper holding pin 33*a* of the paper edge holding mechanism 32*a* into the front edge portion in the conveying direction of the leading first individual sheet FP1-1 of the next cycle.

Then, as shown in FIG. 6(*d*), the stacked body L configured from the leading first individual sheet FP1-1 and the leading second individual sheet FP2-1 and the stacked body L configured from the following first individual sheet FP1-2 and the following second individual sheet FP2-2 are further conveyed toward the folding cylinder 42 by the conveyor mechanism 20. In addition, the first holding cylinder 32 operates to make a half rotation in a state where the leading first individual sheet FP1-1 of the next cycle is held by the paper holding pin 33*a* and wrap said leading first individual sheet FP1-1 around the first holding cylinder 32. Note that states of the first holding cylinder 32 and the second holding cylinder 34 at this time are similar to the states shown in FIG. 5(*b*). Hence, by repeating thereafter operations of FIGS. 5(*c*) to 6(*d*), one each (a total of two) of the stacked bodies L is formed by the first holding cylinder 32 and the second holding cylinder 34 every one cycle.

Then, the folding cylinder 42 operates to sequentially wrap the conveyed stacked bodies L around the folding cylinder by the paper edge holding mechanism 42*a* and thrust substantially the center in the conveying direction of the stacked bodies L by the thrust blade mechanism 42*b* to pass the stacked bodies L to the jaw mechanism 44*a* of the jaw cylinder 44. In addition, the jaw cylinder 44 operates to fold the stacked bodies L in two to form the signature by gripping the stacked bodies L by the jaw mechanism 44*a*, and convey the stacked bodies L toward a post-processing mechanism such as a collecting mechanism installed on a downstream side.

Figure 8:
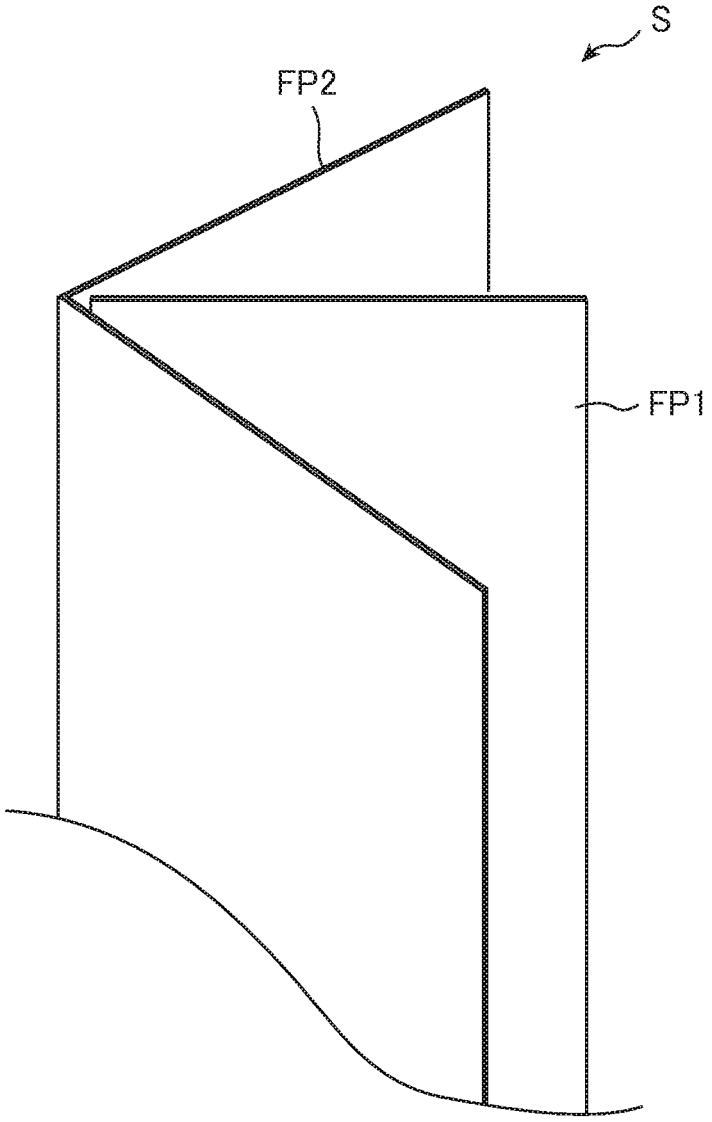
FIG. 8 is a schematic perspective view showing a signature configured from six pages.

As described above, the individual sheet overlapping mechanism 30 according to the present embodiment comprises the holding cylinders 32 and 34 that include the paper edge holding mechanisms 32*a* and 34*a* capable of holding the front edge portion in the conveying direction of the first individual sheet FP1 and that are provided rotatably along the conveying direction of the first individual sheet FP1, the individual sheet overlapping mechanism 30 being configured such that the holding cylinders 32 and 34 wrap the first individual sheet FP1 that has reached said holding cylinders 32 and 34 round said holding cylinders 32 and 34 by the paper edge holding mechanisms 32*a* and 34*a*, release the held first individual sheet FP1 at a timing when the second individual sheet FP2 has reached said holding cylinders 32 and 34, and stack said first individual sheet FP1 on said second individual sheet FP2. As shown in, for example, FIG. 7, such an individual sheet overlapping mechanism 30 makes it possible to overlap the first individual sheets FP1 (FP1-1 and FP1-2) conveyed from the upstream side on the second individual sheets FP2 (FP2-1 and FP2-2) conveyed thereafter. Therefore, by then folding the stacked bodies L in two at substantially their centers in the conveying direction by the folding mechanism 40, it becomes possible to produce a six page signature S of the kind shown in FIG. 8 that has a two page half-size paper (first individual sheet FP1) inserted in a four page signature (second individual sheet FP2).

That concludes description of a preferred embodiment of the present invention, but the technical scope of the present invention is not limited to the scope described in the above-mentioned embodiment. Various changes or improvements may be added to the above-described embodiment.

For example, the above-mentioned embodiment was described taking as an example a mode that produces a six page signature configured from one first individual sheet FP1 and one second individual sheet FP2. However, the present invention is not limited to this mode, and it is also possible to produce a "6+4N (where N is an integer of 1 or more) page" signature of, for example, 10, 14, 18, 22, 26, 30, and 34 pages, and so on, by changing projection timing of the movable cutter blade 16*a* in the cutting mechanism 10 to one time in "2N+3 (where N is an integer of 1 or more)" rotations and executing the so-called collect run in the folding mechanism 40.

Figure 9:
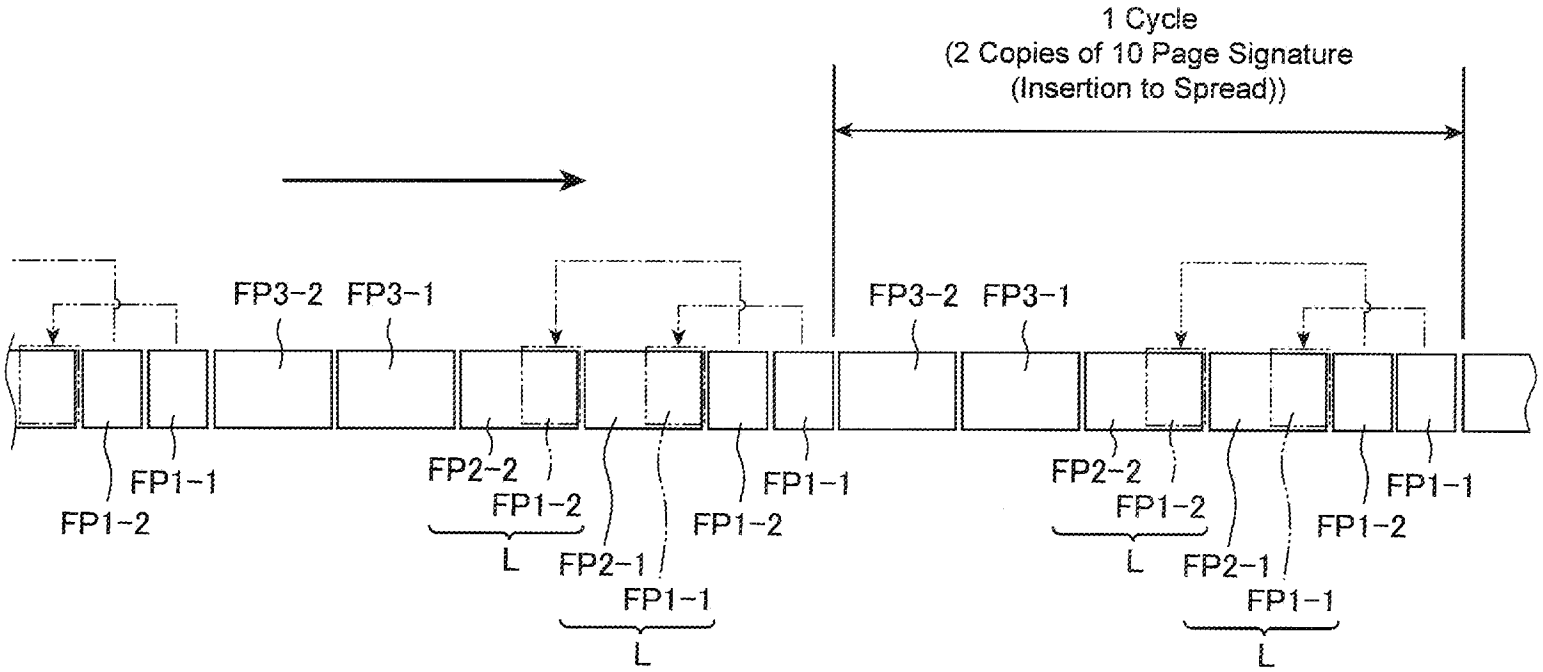
FIG. 9 is a schematic view showing a positional relationship of each of individual sheets when producing a signature configured from 10 pages using a 2 times cylinder folding cylinder and when inserting a first individual sheet into a spread portion.

That is, describing taking as an example a mode that produces, for example, two copies at a time of a 10 page signature, first, projection timing of the movable cutter blade 16*a* of the cutting mechanism 10 is changed to one in five rotations, and the printing-completed continuous paper W is cut in the cutting mechanism 10 such that two first individual sheets FP1-1 and FP1-2 and four second individual sheets FP2-1 and FP2-2 and FP3-1 and FP3-2 are continuously formed. Next, as shown in FIG. 9, the leading first individual sheet FP1-1 is stacked on the leading second individual sheet FP2-1 and the following first individual sheet FP1-2 is stacked on the following second individual sheet FP2-2 by the overlapping processing of the individual sheet overlapping mechanism 30 described in the above-mentioned embodiment, thereby producing two stacked bodies L. Next, by executing the so-called collect run in the folding cylinder 42 such that the subsequent second individual sheets FP3-1 and FP3-2 are respectively stacked on sides of the second individual sheets FP2-1 and FP2-2 of each of the stacked bodies L, a stacked body configured from the leading first individual sheet FP1-1, the leading second individual sheet FP2-1, and the subsequent second individual sheet FP3-1, and a stacked body configured from the following first individual sheet FP1-2, the following second individual sheet FP2-2, and the subsequent second individual sheet FP3-2 are produced in the folding cylinder 42. Then, each of these stacked bodies is passed from the folding cylinder 42 to the jaw cylinder 44 and folded in two at substantially its center in the conveying direction, whereby it is possible to produce two copies at a time of a 10 page signature that has a two page half-size paper (first individual sheet FP1) inserted into a spread portion of an eight page signature.

Figure 10:
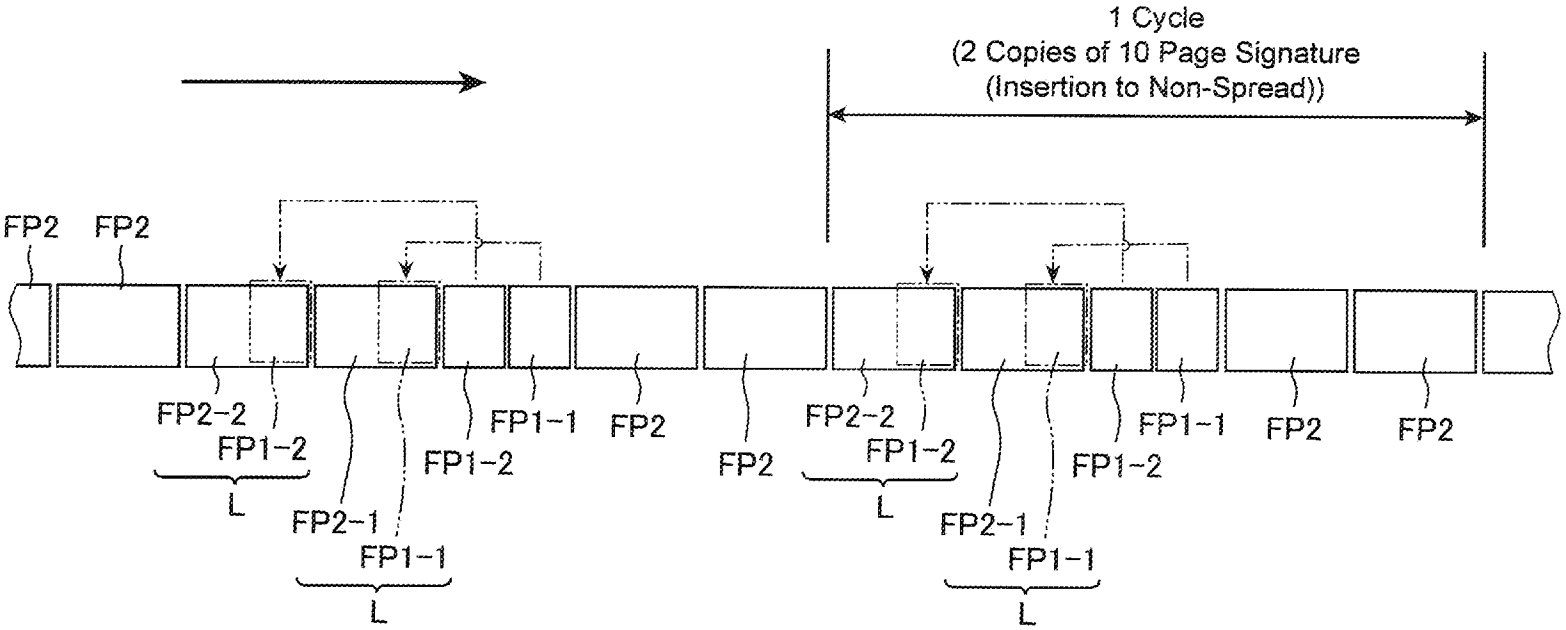
FIG. 10 is a schematic view showing a positional relationship of each of individual sheets when producing a signature configured from 10 pages using a 2 times cylinder folding cylinder and when inserting a first individual sheet into other than a spread portion.

Moreover, in the mode that produces two copies at a time of a 10 page signature, changing the order of the so-called collect run in the folding cylinder 42 makes it possible to change an insertion position of the two page half-size paper (first individual sheet FP1) to a position other than the spread. That is, as shown in FIG. 10, the so-called collect run is executed such that the single second individual sheets FP2 and FP2 are conveyed prior to the stacked bodies L and L and each of the stacked bodies L are respectively stacked on each of the single second individual sheets FP2 in the folding cylinder 42. This makes it possible to produce two copies at a time of a 10 page signature that has the two page half-size paper (first individual sheet FP1) inserted into other than the spread portion of the eight page signature.

In addition, the above-mentioned embodiment was described taking as an example a mode that produces two copies at a time of a signature in one cycle. However, the present invention is not limited to this mode, and it is possible to set the number of signatures produced in one cycle to any number. However, in this case, when the number of signatures it is desired to produce in one cycle is assumed to be N (where N is an integer of 1 or more), the individual sheet overlapping mechanism 30 according to the present embodiment is changed to a configuration in which N holding cylinders are provided and a circumferential length Cn of the n-th (where n is an integer of no less than 1 and no more than N) holding cylinder from an upstream side in the conveying direction is set to "$Cn=(N+n-1)\times P/2$" (where P is the length in the conveying direction of the second individual sheet FP2), and a cutting mode or configuration of the cutting mechanism 10 and a configuration of the folding mechanism 40 are changed according to said any number N.

First, the case where the above-mentioned any number N is an even number will be described taking as examples a mode that produces four copies at a time of a signature in one cycle and a mode that produces six copies at a time of a signature in one cycle. Note that a mode that produces an even number of eight or more copies of signatures in one cycle may be easily understood from these descriptions, hence a description thereof will be omitted.

Figure 11:
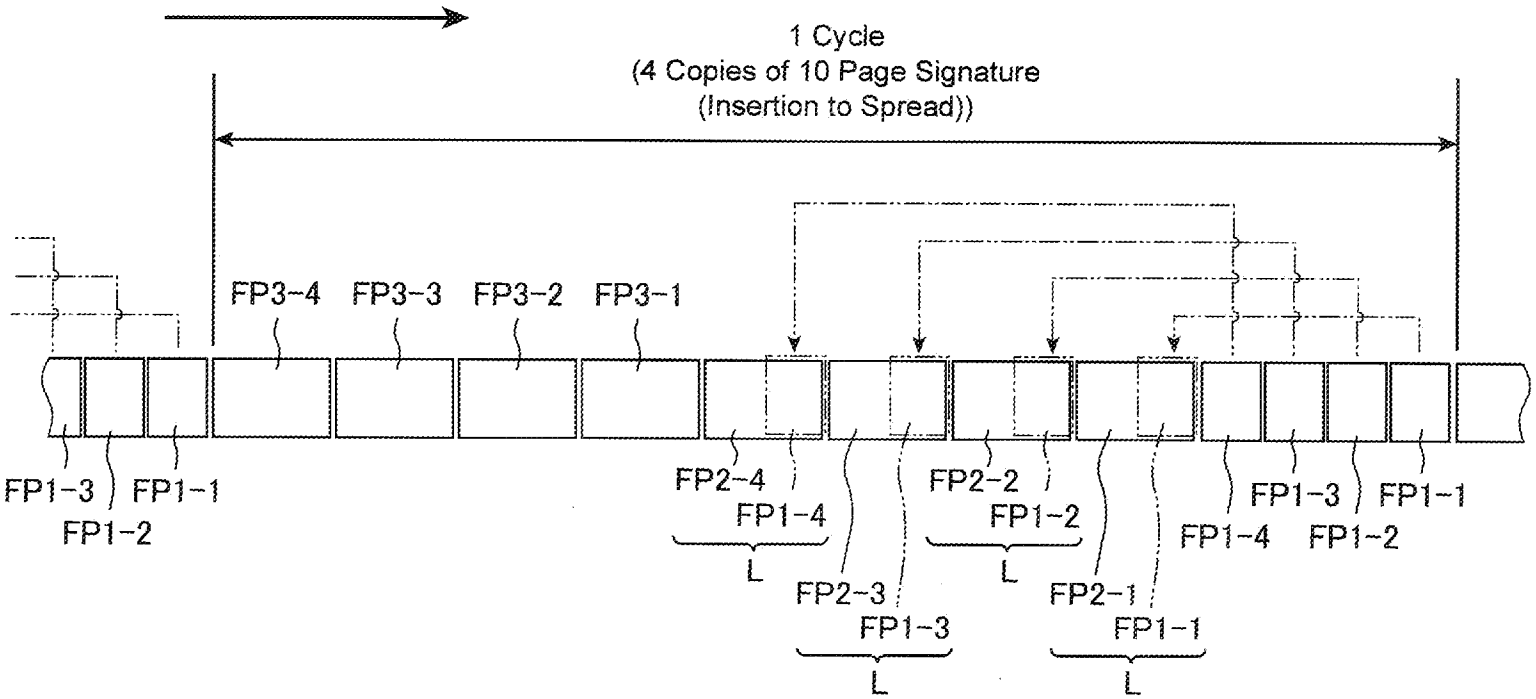
FIG. 11 is a schematic view showing a positional relationship of each of individual sheets when producing a signature configured from 10 pages using a 4 times cylinder folding cylinder and when inserting a first individual sheet into a spread portion.
Figure 12:
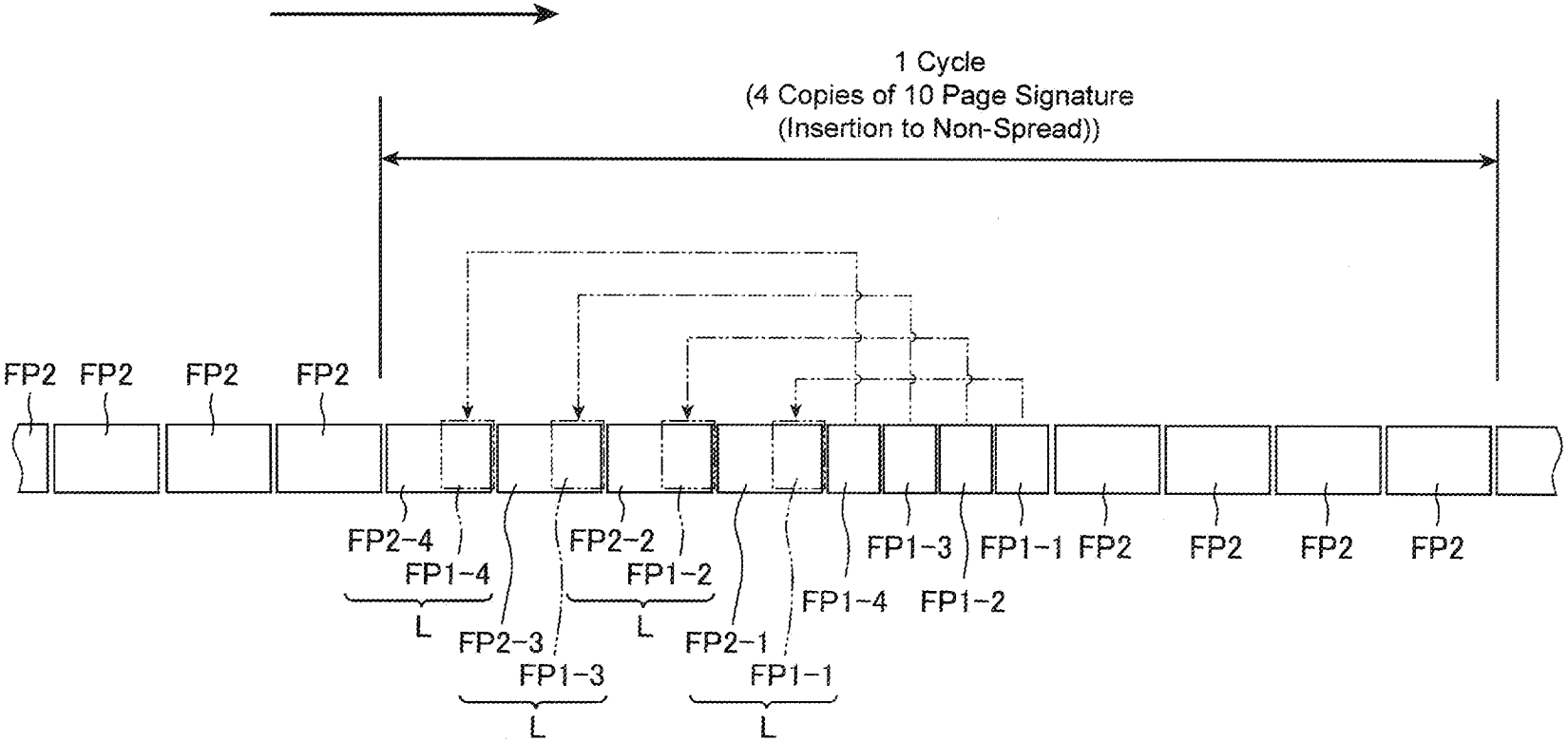
FIG. 12 is a schematic view showing a positional relationship of each of individual sheets when producing a signature configured from 10 pages using a 4 times cylinder folding cylinder and when inserting a first individual sheet into other than a spread portion.

In order to produce four copies at a time of a signature in one cycle, four holding cylinders are installed, and circumferential lengths of these holding cylinders are set to 2 times (2 times cylinder), 2.5 times (2.5 times cylinder), 3 times (3 times cylinder), and 3.5 times (3.5 times cylinder) the length in the conveying direction of the second individual sheet FP2, in order from an upstream side in the conveying direction. In addition, the circumferential length of the folding cylinder 42 of the folding mechanism 40 is set to 4 times (4 times cylinder) the length in the conveying direction of the second individual sheet FP2. Furthermore, the cutting mode of the cutting mechanism 10 is set such that four first individual sheets FP1 are formed continuously, and then four (or a multiple of four) second individual sheets FP2 are formed continuously. Then, as shown in FIG. 11, by employing a folding device modified in this way, a first individual sheet FP1-1 which is the first conveyed of the four first individual sheets FP1 is stacked on a second individual sheet FP2-1 which is the first conveyed of the four second individual sheets FP2 conveyed after the four first individual sheets FP1, and similarly thereafter, the second conveyed first individual sheet FP1-2, the third conveyed first individual sheet FP1-3, and the fourth conveyed first individual sheet FP1-4 are respectively stacked on the second conveyed second individual sheet FP2-2, the third conveyed second individual sheet FP2-3, and the fourth conveyed second individual sheet FP2-4, thereby continuously producing four stacked bodies L. In addition, the so-called collect run is executed in the folding cylinder such that subsequent second individual sheets FP3-1, FP3-2, FP3-3, and FP3-4 are respectively stacked on each of the stacked bodies L, and then each of the stacked bodies is folded in two by a similar processing to the above-mentioned processing. This makes it possible to produce four copies at a time of a 10 page signature that has a two page half-size paper (first individual sheet FP1) inserted into a spread portion of an eight page signature. Moreover, as shown in FIG. 12, changing the cutting order in the cutting mechanism 10 and the order of the so-called collect run in the folding cylinder makes it possible to produce four copies at a time of a 10 page signature that has the two page half-size paper (first individual sheet FP1) inserted into other than the spread portion of the eight page signature.

Figure 13:
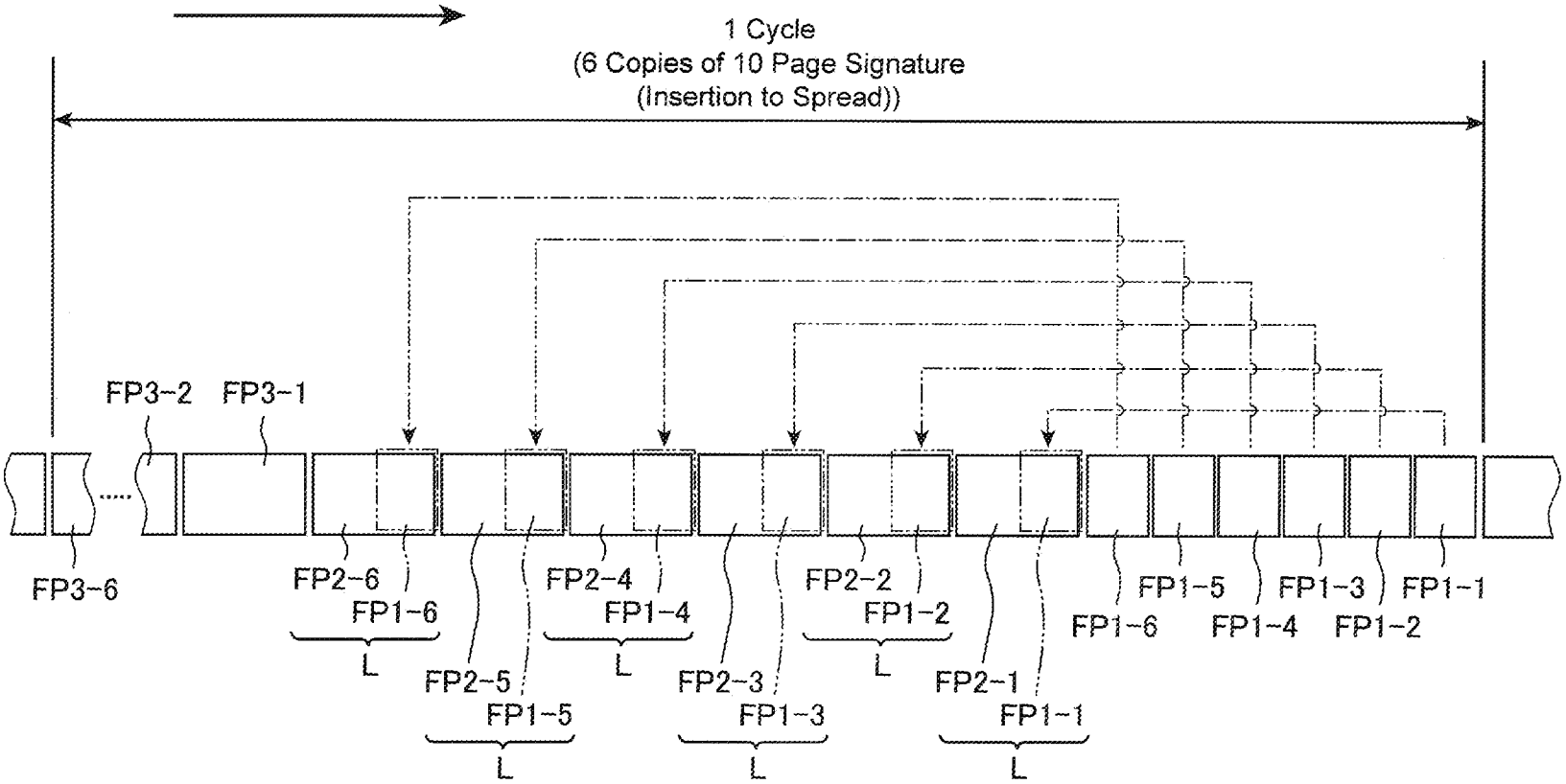
FIG. 13 is a schematic view showing a positional relationship of each of individual sheets when producing a signature configured from 10 pages using a 6 times cylinder folding cylinder and when inserting a first individual sheet into a spread portion.
Figure 14:
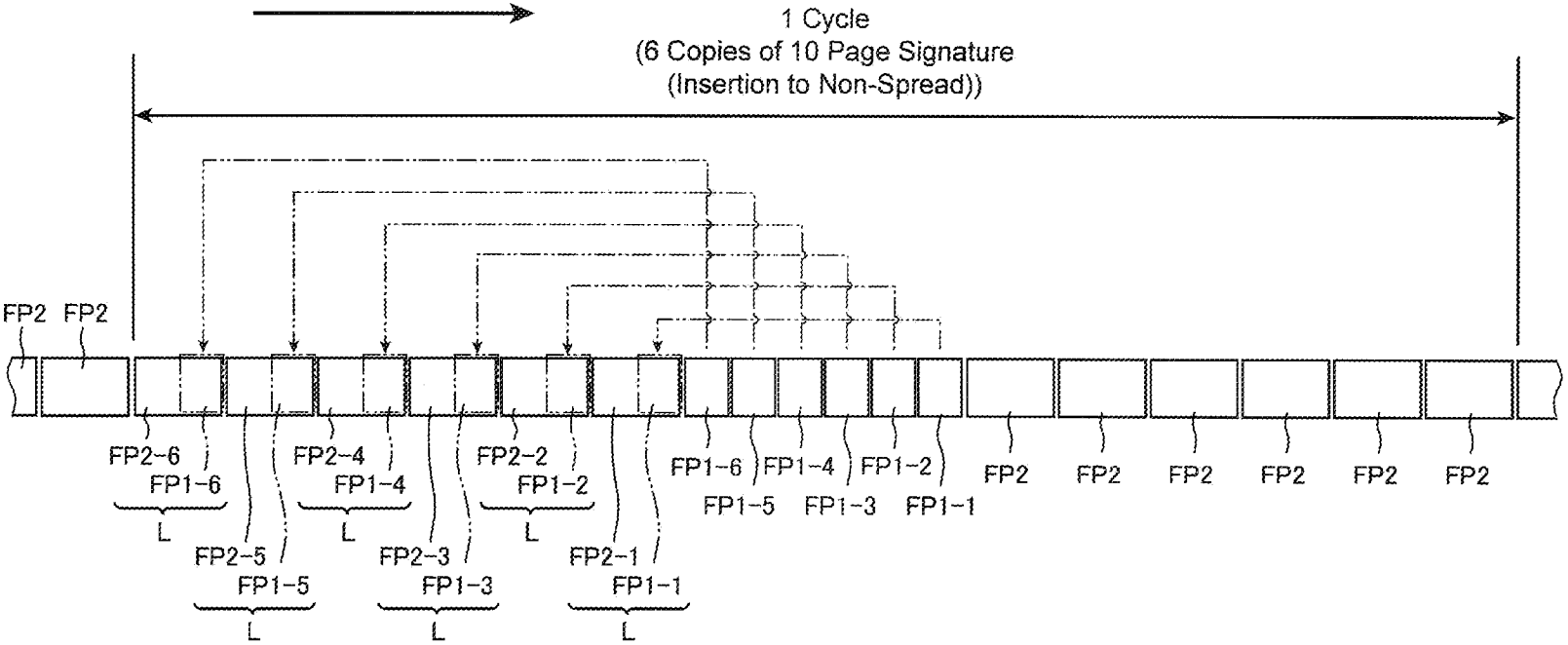
FIG. 14 is a schematic view showing a positional relationship of each of individual sheets when producing a signature configured from 10 pages using a 6 times cylinder folding cylinder and when inserting a first individual sheet into other than a spread portion.

In addition, in order to produce six copies at a time of a signature in one cycle, six holding cylinders are installed, and circumferential lengths of these holding cylinders are set to 3 times (3 times cylinder), 3.5 times (3.5 times cylinder), 4 times (4 times cylinder), 4.5 times (4.5 times cylinder), 5 times (5 times cylinder), and 5.5 times (5.5 times cylinder) the length in the conveying direction of the second individual sheet FP2, in order from an upstream side in the conveying direction. In addition, the circumferential length of the folding cylinder 42 of the folding mechanism 40 is set to 6 times (6 times cylinder) the length in the conveying direction of the second individual sheet FP2. Furthermore, the cutting mode of the cutting mechanism 10 is set such that six first individual sheets FP1 are formed continuously, and then six (or a multiple of six) second individual sheets FP2 are formed continuously. Then, as shown in FIG. 13, by employing a folding device modified in this way, a first individual sheet FP1-1 which is the first conveyed of the six first individual sheets FP1 is stacked on a second individual sheet FP2-1 which is the first conveyed of the six second individual sheets FP2 conveyed after the six first individual sheets FP1, and similarly thereafter, the second conveyed first individual sheet FP1-2, the third conveyed first individual sheet FP1-3, the fourth conveyed first individual sheet FP1-4, the fifth conveyed first individual sheet FP1-5, and the sixth conveyed first individual sheet FP1-6 are respectively stacked on the second conveyed second individual sheet FP2-2, the third conveyed second individual sheet FP2-3, the fourth conveyed second individual sheet FP2-4, the fifth conveyed second individual sheet FP2-5, and the sixth conveyed second individual sheet FP2-6, thereby continuously producing six stacked bodies L. In addition, the so-called collect run is executed in the folding cylinder such that subsequent second individual sheets FP3-1 to FP3-6 are respectively stacked on each of the stacked bodies L, and then each of the stacked bodies is folded in two by a similar processing to the above-mentioned processing. This makes it possible to produce six copies at a time of a 10 page signature that has a two page half-size paper (first individual sheet FP1) inserted into a spread portion of an eight page signature. Moreover, as shown in FIG. 14, changing the order of the so-called collect run in the folding cylinder makes it possible to produce six copies at a time of a 10 page signature that has the two page half-size paper (first individual sheet FP1) inserted into other than the spread portion of the eight page signature.

Next, the case where the above-mentioned any number N is an odd number will be described. In the case of producing an odd number of copies of a signature in one cycle, what differs from the case of producing an even number of copies of a signature in one cycle is that the cutting mechanism 10 is changed to a cutting mechanism that does not include the fixed cutter blade 15 and the folding mechanism 40 is changed to a folding mechanism other than a rotary folding unit. That is, in the cutting mechanism 10 according to the above-mentioned embodiment, the blade edge of the fixed cutter blade 15 is always protruding and the continuous number of first individual sheets FP1 cannot be set to an odd number, hence it is preferable to adopt a configuration in which, for example, the fixed cutter blade 15 of the above-mentioned cutting mechanism 10 is changed to the movable cutter blade 16 to enable projection and retraction at any timing, or to change to another cutting mechanism such as, for example, a piston type cutting mechanism that has no limitation arising from the circumferential length of the cutter cylinder. Moreover, the folding mechanism 40 according to the above-mentioned embodiment is a rotary folding unit comprising the folding cylinder 42 and the jaw cylinder 44, and is rotationally controlled with the same circumferential speed as the conveying speed in the conveyor mechanism 20 at a timing when the paper edge holding mechanism 42*a* provided to the folding cylinder 42 holds the front edge portion in the conveying direction of the second individual sheet FP2 conveyed from the conveyor mechanism 20, hence if an odd number of first individual sheets FP1 having a length which is half of the length in the conveying direction of the second individual sheet FP2 are conveyed, then the timing at which the paper edge holding mechanism 42*a* holds the front edge portion in the conveying direction of the second individual sheet FP2 becomes misaligned. It is therefore necessary to change the folding mechanism to a folding mechanism other than a rotary folding unit such as, for example, a folding mechanism comprising: N collecting devices; a sorting device that sorts the N stacked bodies L conveyed by the conveyor mechanism 20 and the integer multiple of N second individual sheets FP2 conveyed before and after the N stacked bodies L to be respectively conveyed one at a time to each of the collecting devices; and a folding device such as a chopper that folds in two the individual sheet group configured from the stacked body L and one or more second individual sheets FP2 collected in each of the collecting devices and thereby forms a signature. Note that even when producing an odd number of copies of a signature in one cycle, N holding cylinders are provided and the circumferential length Cn of the n-th holding cylinder from an upstream side in the conveying direction is set to "$Cn=(N+n-1)\times P/2$" (where P is the length in the conveying direction of the second individual sheet FP2), similarly to when producing an even number of copies of a signature in one cycle. Such a modified folding device makes it possible to produce an odd number of copies of a signature in one cycle. It is of course also possible to produce an even number of copies of a signature by such a modified cutting mechanism and folding mechanism.

Note that in the above description, it was described that the circumferential length Cn of the n-th holding cylinder from an upstream side in the conveying direction is set to "$Cn=(N+n-1)\times P/2$" (where P is the length in the conveying direction of the second individual sheet FP2). However, the present invention is not limited to such a holding cylinder, and it is only required that each of the holding cylinders is capable of temporarily diverting the holding-target first individual sheet FP1 from the conveying path, releasing the held first individual sheet FP1 when the stacking-target second individual sheet FP2 has arrived, and returning the first individual sheet FP1 to the conveying path so as to be stacked on the second individual sheet FP2. That is, said configuration of the circumferential length is the configuration in the case that each of the holding cylinders rotates with the same speed as the conveying speed of each of the individual sheets FP1 and FP2, and in the case that, for example, the circumferential speed (rotating speed) of each of the holding cylinders is variably controlled or controlled for intermittent operation, the circumferential length of each of the cylinders need only be set longer than a length enabling the first individual sheet FP1 to be wrapped around, specifically longer than the length in the conveying direction of the first individual sheet FP1. Note that in the case that each of the holding cylinders is variably controlled or controlled for intermittent operation in this way, a control unit of each of the holding cylinders is preferably configured to execute synchronous control with the conveyor mechanism 20 such that the first individual sheet FP1 can be released at an appropriate timing to be stacked on the second individual sheet FP2 according to the conveying speed of the conveyor mechanism 20.

Moreover, the above-mentioned embodiment was described assuming that the length in the conveying direction of the first individual sheet FP1 is half of the length in the conveying direction of the second individual sheet FP2. However, the present invention is not limited to this configuration. For example, when employing a rotary folding unit as the folding mechanism, the first individual sheet FP1 need only have a length in the conveying direction which is half or less of the length in the conveying direction of the second individual sheet FP2. On the other hand, when employing a folding mechanism other than a rotary folding unit, of the likes of, for example, the above-mentioned folding mechanism comprising N collecting devices, a sorting device, and a folding device, the first individual sheet FP1 need only have a length in the conveying direction which is shorter than the length in the conveying direction of the second individual sheet FP2.

Moreover, in the above-mentioned embodiment, it was described that the cutting mechanism 10 is a rotary cutting mechanism comprising a cutter cylinder 12 and a cutter-receiving cylinder 14, and that the cutter cylinder 12 comprises a fixed cutter blade 15 and a movable cutter blade mechanism 16. However, the present invention is not limited to this cutting mechanism, and the cutting mechanism 10 need only be capable of cutting without hindering flow of the continuous paper W and capable of forming two or more individual sheets having different cutoffs (cutting lengths). For example, blades provided to the cutter cylinder may both be configured as movable cutter blades, or a configuration may be adopted in which the cutter cylinder is provided with only one blade (a fixed cutter blade or a movable cutter blade) and the circumferential speed (rotating speed) of the cutter cylinder is varied according to cutting timing. Moreover, the cutting mechanism may be configured as a piston type cutter capable of changing its cutting interval.

Moreover, the above-mentioned embodiment described the first guide member 27 and the second guide member 29 as being plate-like members. However, the present invention is not limited to these guide members, and the guide members may be configured as a conveyor belt, provided that installation space can be secured.

It is clear from descriptions of scope in the patent claims that modified examples of the kind described above are included in the scope of the present invention.

What is claimed is:

1. An individual sheet overlapping mechanism for overlapping a first individual sheet on a second individual sheet, the first individual sheet being conveyed from an upstream side and the second individual sheet being conveyed thereafter and having a length in a conveying direction which is longer than a length in the conveying direction of the first individual sheet, the individual sheet overlapping mechanism comprising:

a holding cylinder that includes a paper edge holding mechanism capable of holding a front edge portion in the conveying direction of the first individual sheet and that is provided rotatably along the conveying direction of the first individual sheet, the holding cylinder being configured to wrap the first individual sheet that has reached said holding cylinder around said holding cylinder by the paper edge holding mechanism, release said first individual sheet at a timing when the second individual sheet has reached said holding cylinder, and stack said first individual sheet on said second individual sheet.

2. The individual sheet overlapping mechanism according to claim 1, wherein the individual sheet overlapping mechanism is an individual sheet overlapping mechanism for overlapping each first individual sheet of a plurality of the first individual sheets conveyed continuously from the upstream side on each second individual sheet of a plurality of the second individual sheets conveyed continuously thereafter, and the same number of the holding cylinders as the number of continuously conveyed first individual sheets are provided along a conveying path of the first individual sheet and each of the holding cylinders holds one each of the first individual sheets and stacks the first individual sheet on each of the second individual sheets, thereby configuring the holding cylinder to produce the same number of stacked bodies as the number of continuously conveyed first individual sheets.

3. A folding device comprising the individual sheet overlapping mechanism recited in claim 1, the folding device further comprising:

a cutting mechanism configured to be capable of switching between a first cutting mode and a second cutting mode at any timing, the first cutting mode cutting a continuous paper to the length in the conveying direction of the first individual sheet and the second cutting mode cutting the continuous paper to the length in the conveying direction of the second individual sheet;

a conveyor mechanism that is provided on a downstream side of the cutting mechanism and conveys the first individual sheet and the second individual sheet; and a folding mechanism that is provided on a downstream side of the conveyor mechanism and folds an individual sheet group including at least a stacked body of the first individual sheet stacked on the second individual sheet, and the individual sheet overlapping mechanism being provided on a conveying path of the conveyor mechanism.

4. A printing apparatus comprising the folding device recited in claim 3, the printing apparatus further comprising:

an ink jet printing unit provided on an upstream side of the cutting mechanism.

5. An individual sheet overlapping method for overlapping a first individual sheet on a second individual sheet, the first individual sheet being conveyed from an upstream side and the second individual sheet being conveyed thereafter and having a length in a conveying direction which is longer than a length in the conveying direction of the first individual sheet, the individual sheet overlapping method comprising:

employing an individual sheet overlapping mechanism comprising a holding cylinder that includes a paper edge holding mechanism capable of holding a front edge portion in the conveying direction of the first individual sheet and that is provided rotatably along the conveying direction of the first individual sheet to wrap the first individual sheet that has reached the holding cylinder around said holding cylinder by the paper edge holding mechanism, and then release said first individual sheet at a timing when the second individual sheet has reached said holding cylinder, thereby stacking said first individual sheet on said second individual sheet.

* * * * *